US008760354B2

(12) United States Patent
Clymer et al.

(10) Patent No.: US 8,760,354 B2
(45) **Date of Patent: *Jun. 24, 2014**

(54) COMMUNICATION SYSTEM WITH BROADBAND ANTENNA

(75) Inventors: Richard Clymer, Concord, NH (US); Michael Barrett, Temple, NH (US); Frank Blanda, Nashua, NH (US); Robert Krivicich, Brookline, NH (US); Richard B. Anderson, Aurora, OH (US); Matthew Flannery, Girard, OH (US)

(73) Assignee: Astronics Aerosat Corporation, East Aurora, NY (US)

( * ) Notice: Subject to any disclaimer, the term of this patent is extended or adjusted under 35 U.S.C. 154(b) by 386 days.

This patent is subject to a terminal disclaimer.

(21) Appl. No.: 12/876,552

(22) Filed: Sep. 7, 2010

(65) Prior Publication Data

US 2011/0215976 A1 Sep. 8, 2011

Related U.S. Application Data

(60) Continuation of application No. 12/176,808, filed on Jul. 21, 2008, now Pat. No. 7,791,549, which is a continuation of application No. 11/234,870, filed on Sep. 23, 2005, now Pat. No. 7,403,166, which is a division of application No. 10/644,493, filed on Aug. 20, 2003, now Pat. No. 6,950,073.

(60) Provisional application No. 60/405,080, filed on Aug. 20, 2002, provisional application No. 60/409,629, filed on Sep. 10, 2002.

(51) Int. Cl.

| | |
|---|---|
| ***H01Q 1/28*** | (2006.01) |
| ***H01Q 15/02*** | (2006.01) |
| ***H01Q 19/06*** | (2006.01) |

(52) U.S. Cl.

USPC ..... 343/705; 343/910; 343/911 R

(58) Field of Classification Search

USPC ..... 343/705, 753, 882, 910, 911 R, 911 L

See application file for complete search history.

(56) References Cited

U.S. PATENT DOCUMENTS

| | | | |
|---|---|---|---|
| 390,350 | A | 10/1888 | Denton |
| 2,718,592 | A | 9/1955 | Smith |

(Continued)

FOREIGN PATENT DOCUMENTS

| | | | |
|---|---|---|---|
| CH | 664848 | A5 | 3/1988 |
| EP | 0390350 | A2 | 10/1990 |

(Continued)

OTHER PUBLICATIONS

Storkus, "Design Techniques for Compact Monopulse Antenna Feeds for W-Band Radar Systems," IEEE MTT-S International Microwave Symposium-Digest, May 8-10, 1990, pp. 805-808.

(Continued)

*Primary Examiner* — Hoang V Nguyen
*Assistant Examiner* — Patrick Holecek
(74) *Attorney, Agent, or Firm* — Lando & Anastasi, LLP

(57) ABSTRACT

A communication system including an antenna array with feed network coupled to communication electronics. In one example, a communication subsystem comprises a plurality of antennas each adapted to receive an information signal and a plurality of orthomode transducers coupled to corresponding ones of the plurality of antennas, each OMT is adapted to provide at a first component signal having a first polarization and a second component signal having a second polarization. The communication subsystem also comprises a feed network that receives the first component signal and the second component signal from each orthomode transducer and provides a first summed component signal at a first feed port and a second summed component signal at a second feed port, and a phase correction device coupled to the first and second feed ports and adapted to phase match the first summed component signal with the second summed component signal.

35 Claims, 22 Drawing Sheets

(56) References Cited

U.S. PATENT DOCUMENTS

| | | | | | |
|---|---|---|---|---|---|
| 2,764,757 | A | | 9/1956 | Rust et al. | |
| 2,884,629 | A | | 4/1959 | Mason | |
| 2,908,002 | A | | 10/1959 | Van Atta | |
| 3,102,263 | A | * | 8/1963 | Meyer | 342/113 |
| 3,329,958 | A | * | 7/1967 | Anderson | 343/753 |
| 3,623,111 | A | | 11/1971 | Provencher et al. | |
| 4,210,915 | A | * | 7/1980 | Kienberger et al. | 343/786 |
| 4,228,410 | A | | 10/1980 | Goudey et al. | |
| 4,366,453 | A | | 12/1982 | Schwarz | |
| 4,498,061 | A | | 2/1985 | Morz et al. | |
| 4,673,943 | A | | 6/1987 | Hannan | |
| 4,827,269 | A | | 5/1989 | Shestag et al. | |
| 4,951,061 | A | | 8/1990 | Lee | |
| 5,086,304 | A | | 2/1992 | Collins | |
| 5,166,698 | A | | 11/1992 | Ashbaugh et al. | |
| 5,305,001 | A | * | 4/1994 | Wong et al. | 343/786 |
| 5,359,338 | A | | 10/1994 | Hatcher, Jr. et al. | |
| 5,973,647 | A | | 10/1999 | Barrett et al. | |
| 6,023,246 | A | | 2/2000 | Tanabe | |
| 6,201,508 | B1 | | 3/2001 | Metzen et al. | |
| 6,208,307 | B1 | * | 3/2001 | Frisco et al. | 343/757 |
| 6,307,523 | B1 | * | 10/2001 | Green et al. | 343/781 CA |
| 6,366,244 | B1 | | 4/2002 | Fernandes | |
| 6,388,621 | B1 | | 5/2002 | Lynch | |
| 6,807,396 | B2 | | 10/2004 | Horie et al. | |
| 6,950,073 | B2 | * | 9/2005 | Clymer et al. | 343/713 |
| 6,992,639 | B1 | | 1/2006 | Lier | |
| 7,403,166 | B2 | | 7/2008 | Clymer et al. | |
| 7,423,604 | B2 | | 9/2008 | Nagai | |
| 7,791,549 | B2 | | 9/2010 | Clymer et al. | |
| 2007/0001918 | A1 | | 1/2007 | Ebling et al. | |
| 2010/0188304 | A1 | | 7/2010 | Clymer et al. | |

FOREIGN PATENT DOCUMENTS

| | | | |
|---|---|---|---|
| EP | 0390350 | B1 | 2/1995 |
| GB | 2108770 | A | 5/1983 |
| GB | 2208969 | A | 4/1989 |
| GB | 2232010 | A | 11/1990 |
| JP | 59-022403 | U | 2/1984 |
| JP | 04-150501 | A | 5/1992 |
| JP | 06061900 | A | 3/1994 |

OTHER PUBLICATIONS

International Search Report dated Jan. 14, 2004 for PCT Application No. PCT/US03/26226.

* cited by examiner

COMMUNICATION SYSTEM WITH BROADBAND ANTENNA

REFERENCE TO RELATED APPLICATIONS

This application is a continuation of, and claims priority under 35 U.S.C. §120, to co-pending U.S. application Ser. No. 12/176,808 filed Jul. 21, 2008 and entitled "Communication System with Broadband Antenna," which is a continuation of, and claims priority under 35 U.S.C. §102 to, U.S. application Ser. No. 11/234,870, now U.S. Pat. No. 7,403,166, filed Sep. 23, 2005, and entitled "Communication System with Broadband Antenna," which is a divisional of, and claims priority under 35 U.S.C. §120 and §121 to, U.S. patent application Ser. No. 10/644,493, filed Aug. 20, 2003, now U.S. Pat. No. 6,950,073 which in turn claims priority under 35 U.S.C. §119(e) to U.S. Provisional application Ser. No. 60/405,080 entitled "Communication System with Broadband Antenna," filed Aug. 20, 2002 and U.S. Provisional application Ser. No. 60/409,629 entitled "Communication System with Broadband Antenna," filed Sep. 10, 2002, all of which are incorporated herein by reference in their entireties.

BACKGROUND

1. Field of the Invention

The present invention relates to wireless communication systems, in particular, to an antenna and communications subsystem that may be used on passenger vehicles.

2. Discussion of Related Art

Many communication systems involve reception of an information signal from a satellite. Conventional systems have used many types of antennas to receive the signal from the satellite, such as Rotman lenses, Luneberg lenses, dish antennas or phased arrays. However, each of these systems may suffer from limited field of view or low efficiency that limit their ability to receive satellite signals. In particular, these conventional systems may lack the performance required to receive satellite signals where either the signal strength is low or noise is high, for example, signals from low elevation satellites.

One measure of performance of a communication or antenna subsystem may be its gain versus noise temperature, or G/T. Conventional systems tend to have a G/T of approximately 9 or 10, which may often be insufficient to receive low elevation satellite signals or other weak/noisy signals. In addition, many conventional systems do not include any or sufficient polarization correction and therefore cross-polarized signal noise may interfere with the desired signal, preventing the system from properly receiving the desired signal.

There is therefore a need for an improved communication system, including an improved antenna system, that is able to receive weak signals or communication signals in adverse environments.

SUMMARY OF THE INVENTION

Aspects and embodiments of the present invention are directed to lens antenna assemblies.

According to one embodiment, an internal-step Fresnel dielectric lens comprises a first, exterior surface having at least one exterior groove formed therein, a second, opposing surface having at least one groove formed therein, and a single step Fresnel feature formed within an interior of the dielectric lens, the single step Fresnel feature having a first boundary adjacent the second surface and a second, opposing boundary, wherein the second boundary has at least one groove formed therein.

In one example, the internal-step Fresnel dielectric lens comprises a cross-linked polymer polystyrene material. In another example, the material is Rexolite®.

In another example, the first surface of the dielectric lens is convex in shape and the second surface of the lens is planar. The single step Fresnel feature may be trapezoidal in shape with the first boundary being substantially parallel to the second surface of the lens. The at least one groove may be formed on any of the first surface of the lens, the second surface of the lens and the second boundary of the single step Fresnel feature comprises a plurality of grooves formed as concentric rings.

According to another embodiment, an antenna assembly comprises a first horn antenna adapted to receive a signal from a source, a second horn antenna, substantially identical to the first antenna, and adapted to receive the signal, a first dielectric lens coupled to the first horn antenna to focus the signal to a feed point of the first horn antenna, the first dielectric lens having at least one groove formed in a surface thereof, a second dielectric lens coupled to the second horn antenna to focus the signal to a feed point of the second horn antenna, the second dielectric lens having at least one groove formed in a surface thereof, and a waveguide feed network coupled to the feed points of the first and second horn antennas and including a first feed port and a second feed port, the waveguide feed network being constructed to receive the signal from the horn antennas and to provide a first component signal having a first polarization at the first feed port and a second component signal having a second polarization at the second feed port. The antenna assembly further comprises a polarization converter unit coupled to the first feed port and the second feed port and comprising means for compensating for any polarization skew between the signal and the source.

In one example, the dielectric lenses are internal-step Fresnel lenses.

BRIEF DESCRIPTION OF THE DRAWINGS

The foregoing, and other objects, features and advantages of the system will be apparent from the following non-limiting description of various exemplary embodiments, and from the accompanying drawings, in which like reference characters refer to like elements through the different figures.

DETAILED DESCRIPTION

Figure 1A:
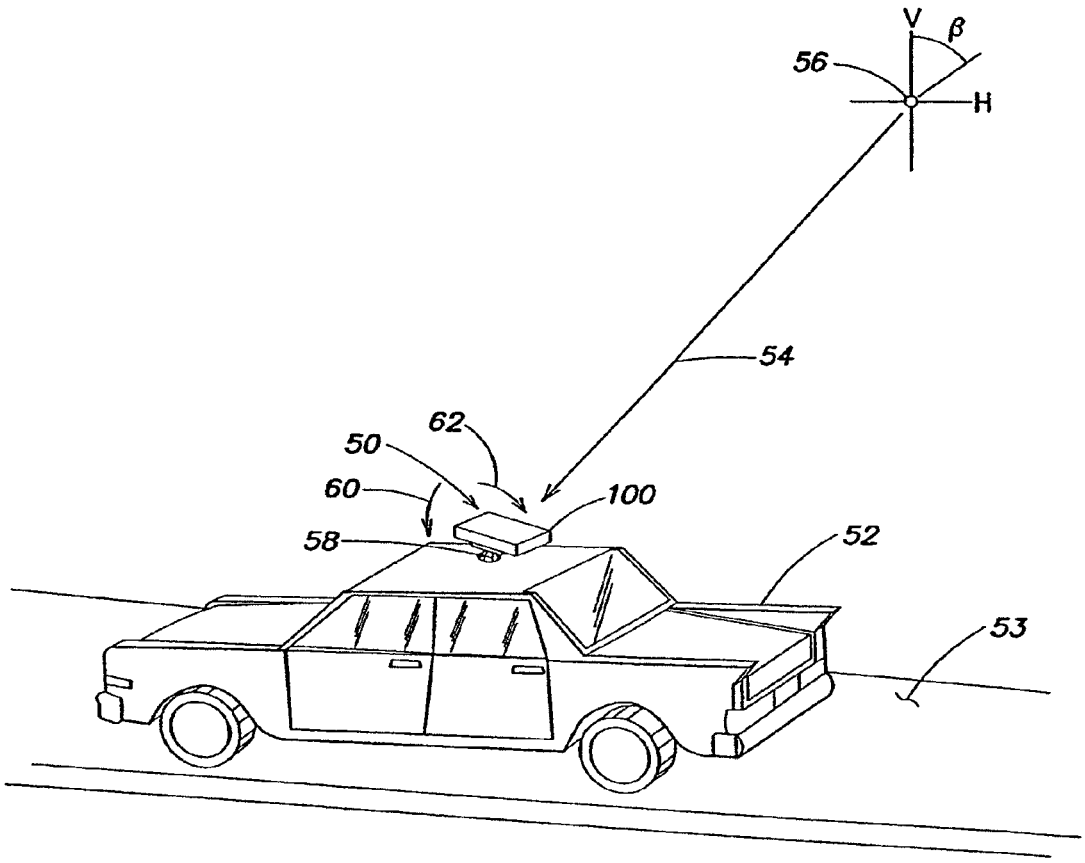
FIGS. 1A and 1B are perspective views of a portion of a communication system including a subsystem mounted on a vehicle.

A communication system described herein includes a subsystem for transmitting and receiving an information signal that can be associated with a vehicle, such that a plurality of so-configured vehicles create an information network, e.g., between an information source and a destination. Each subsystem may be, but need not be, coupled to a vehicle, and each vehicle may receive the signal of interest. In some examples, the vehicle may be a passenger vehicle and may present the received signal to passengers associated with the vehicle. In some instances, these vehicles may be located on pathways (i.e., predetermined, existing and constrained ways along which vehicles may travel, for example, roads, flight tracks or shipping lanes) and may be traveling in similar or different directions. The vehicles may be any type of vehicles capable of moving on land, in the air, in space or on or in water. Some specific examples of such vehicles include, but are not limited to, trains, rail cars, boats, aircraft, automobiles, motorcycles, trucks, tractor-trailers, buses, police vehicles, emergency vehicles, fire vehicles, construction vehicles, ships, submarines, barges, etc.

It is to be appreciated that the invention is not limited in its application to the details of construction and the arrangement of components set forth in the following description or illustrated in the drawings. The invention is capable of other embodiments and of being practiced or of being carried out in various ways. Also, the phraseology and terminology used herein is for the purpose of description and should not be regarded as limiting. The use of "including," "comprising," or "having," "containing", "involving", and variations thereof herein, is meant to encompass the items listed thereafter and equivalents thereof as well as additional items. In addition, for the purposes of this specification, the term "antenna" refers to a single antenna element, for example, a single horn antenna, patch antenna, dipole antenna, dish antenna, or other type of antenna, and the term "antenna array" refers to one or more antennas coupled together and including a feed network designed to provide electromagnetic signals to the antennas and to receive electromagnetic signals from the antennas.

Figure 1B:
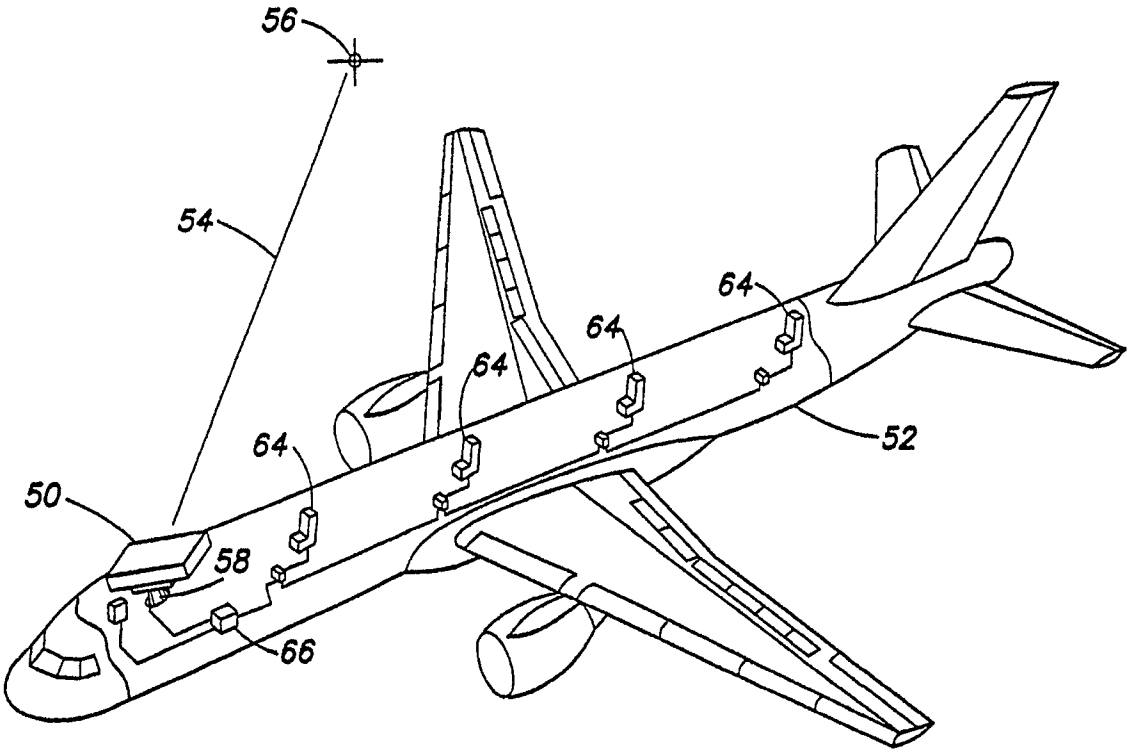

Referring to FIGS. 1A and 1B, there are illustrated exemplary portions of a communication system according to two respective embodiments, including a mountable subsystem 50 that may be mounted on a vehicle 52. It is to be appreciated that although the vehicle 52 is illustrated as an automobile in FIG. 1A and an aircraft in FIG. 1B, the vehicle may be any type of vehicle, as discussed above. Additionally, the vehicle 52 may be traveling along a pathway 53. The mountable subsystem 50 may include an antenna, as discussed in more detail below, that may be adapted to receive an information signal of interest 54 from an information source 56. The information source 56 may be another vehicle, a satellite, a fixed, stationary platform, such as a base station, tower or broadcasting station, or any other type of information source. The information signal 54 may be any communication signal, including but not limited to, TV signals, signals encoded (digitally or otherwise) with maintenance, positional or other information, voice or audio transmissions, etc. The mountable subsystem 50 may be positioned anywhere convenient on vehicle 52. For example, the mountable subsystem 50 may be mounted on the roof of an automobile (as shown in FIG. 1A) or on a surface of an aircraft, such as on the upper or lower surface of the fuselage (as shown in FIG. 1B) or on the nose or wings. Alternatively, the mountable subsystem 50 may be positioned within, or partially within, the vehicle 52, for example, within the trunk of an automobile or on, within, or partially within the tail or empenage of an aircraft.

The mountable subsystem 50 may include a mounting bracket 58 to facilitate mounting of the mountable unit 50 to the vehicle 52. According to one embodiment, the mountable unit may be moveable in one or both of elevation and azimuth to facilitate communication with the information source 56 from a plurality of locations and orientations. In this embodiment, the mounting bracket 58 may include, for example, a rotary joint and a slip ring 57, shown on FIG. 3, as discrete parts or as an integrated assembly, to allow radio frequency (RF), power and control signals to travel, via cables, between the movable mountable subsystem 50 and a stationary host platform of the vehicle 52. The rotary joint and slip ring combination 57, or other device known to those of skill in the art, may enable the mountable subsystem 50 to rotate continuously in azimuth in either direction 60 or 62 (see FIG. 1A) with respect to the host vehicle 52, thereby enabling the mountable subsystem to provide continuous hemispherical, or greater, coverage when used in combination with an azimuth motor. Without the rotary joint, or similar device, the mountable subsystem 50 would have to travel until it reached a stop then travel back again to keep cables from wrapping around each other.

The mounting bracket 58 may allow for ease of installation and removal of the mountable subsystem 50 while also penetrating a surface of the vehicle to allow cables to travel between the antenna system and the interior of the vehicle. Thus, signals, such as the information, control and power signals, may be provided to and from the mountable subsystem 50 and devices, such as a display or speakers, located inside the vehicle for access by passengers.

Referring to FIG. 1B, mountable subsystem 50 may be coupled to a plurality of passenger interfaces, such as seatback display units 64, associated headphones and a selection panel to provide channel selection capability to each passenger. Alternatively, video may also be distributed to all passengers for shared viewing through a plurality of screens placed periodically in the passenger area of the aircraft. Further, the system may also include a system control/display station 66 that may be located, for example, in the cabin area for use by, for example, a flight attendant on a commercial airline to control the overall system and such that no direct human interaction with the mountable subsystem 50 is needed except for servicing and repair. The communication system may also include satellite receivers (not shown) that may be located, for example, in a cargo area of the aircraft. Thus, the mountable subsystem 50 may be used as a front end of a satellite video reception system on a moving vehicle such as the automobile of FIG. 1A and the aircraft of FIG. 1B. The satellite video reception system can be used to provide to any number of passengers within the vehicle with live programming such as, for example, news, weather, sports, network programming, movies and the like.

Figure 2:
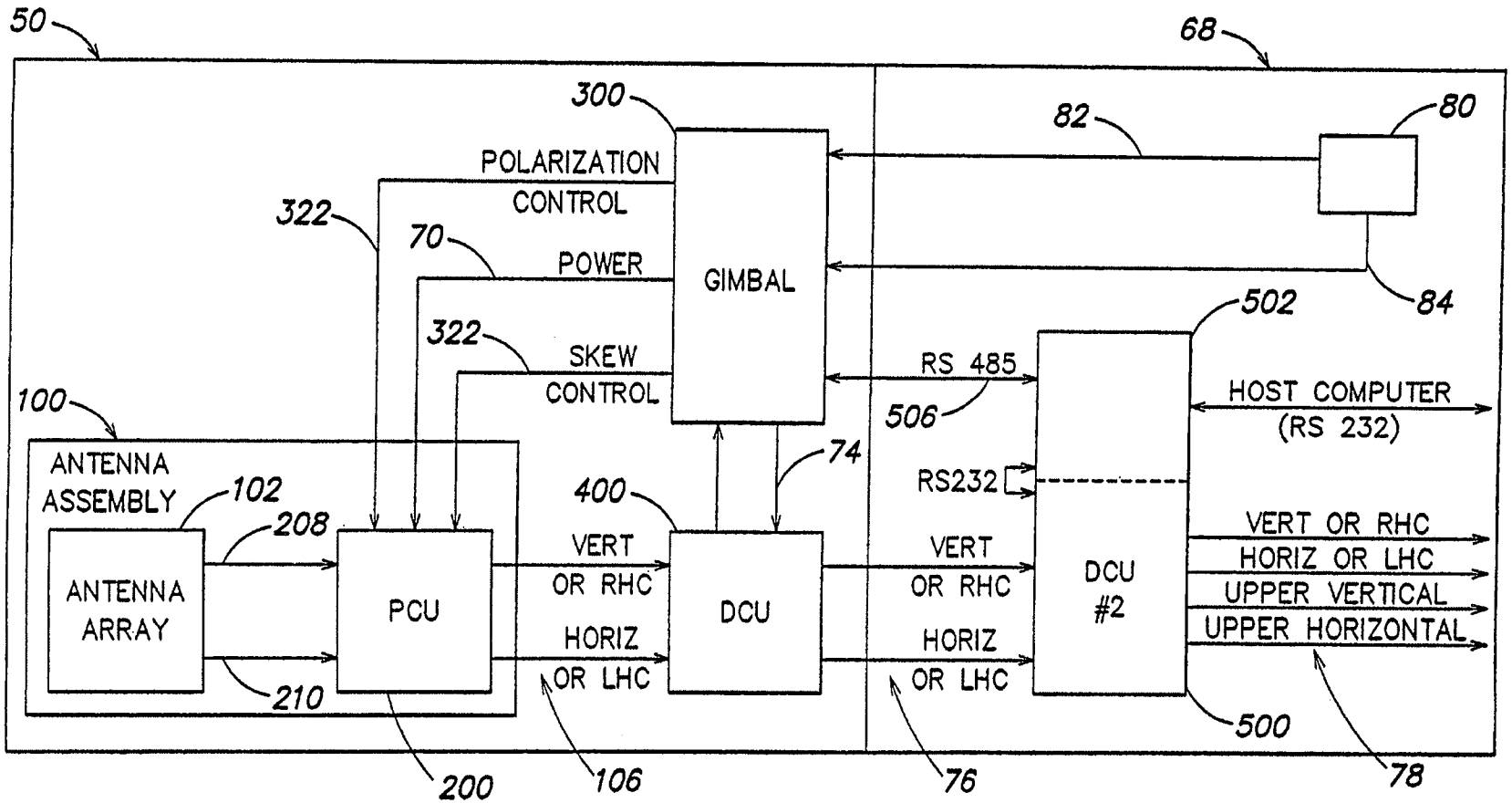
FIG. 2 is a functional block diagram of one embodiment of a communication subsystem according to aspects of the invention.

According to one embodiment, illustrated as a functional block diagram in FIG. 2, the communication system may include the mountable subsystem 50 coupled to a secondary unit 68. In one example, the mountable subsystem 50 may be mounted external to the vehicle and may be covered, or partially covered, by a radome (not shown). The radome may provide environmental protection for the mountable subsystem 50, and/or may serve to reduce drag force generated by the mountable subsystem 50 as the vehicle moves. The radome may be transmissive to radio frequency (RF) signals transmitted and/or received by the mountable subsystem 50. According to one example, the radome may be made of materials known to those of skill in the art including, but not limited to, laminated plies of fibers such as quartz or glass, and resins such as epoxy, polyester, cyanate ester or bismaleamide. These or other materials may be used in combination with honeycomb or foam to form a highly transmissive, lightweight radome construction.

Again referring to FIG. 2, in one embodiment, the mountable subsystem 50 may comprise an antenna assembly 100 that may include an antenna array 102 and a polarization converter unit (PCU) 200. In a receive mode of the communication system, the antenna array 102 may be adapted to receive incident radiation from the information source (56, FIGS. 1A & 1B), and may convert the received incident electromagnetic radiation into two orthogonal electromagnetic wave components. From these two orthogonal electromagnetic wave components, the PCU may reproduce transmitted information from the source whether the polarization of the signals is vertical, horizontal, right hand circular (RHC), left hand circular (LHC), or slant polarization from 0° to 360°, and provide RF signals on lines 208, 210. A part of, or the complete, PCU 200 may be part of, or may include, or may be attached to a feed network of the antenna array. The PCU 200 may receive the signals on lines 106, and provide a set of either linearly (vertical and horizontal) polarized or circularly (right-hand and left-hand) polarized signals on lines 106. Thus, the antenna array 102 and the PCU 200 provide an RF interface for the subsystem, and may provide at least some of the gain and phase-matching for the system. In one embodiment, the PCU may eliminate the need for phase-matching for the other RF electronics of the system. The antenna assembly 100, including the antenna array 102 and the PCU 200, will be discussed in more detail infra.

As shown in FIG. 2, the mountable subsystem 50 may also include a gimbal assembly 300 coupled to the PCU 200. The gimbal assembly 300 may provide control signals, e.g. on lines 322, to the PCU 200 to perform polarization and/or skew control. The gimbal assembly 300 may also provide control signals to move the antenna array 102 over a range of angles in azimuth and elevation to perform beam-steering and signal tracking. The gimbal assembly 300 will be described in more detail infra.

According to an embodiment, the mountable subsystem 50 may further include a down-converter unit (DCU) 400, which may receive power from the gimbal assembly 300 over line(s) 74. The DCU 400, may receive input signals, e.g. the linearly or circularly polarized signals on lines 106, from the antenna assembly 100 and may provide output signals, e.g. linearly or circularly polarized signals, on lines 76, at a lower frequency than the frequency of the input signals received on lines 106. The DCU 400 will be described in more detail infra.

According to one embodiment, the mountable subsystem 50 may be coupled, for example, via cables extending through the mounting bracket (58, FIGS. 1A & 1B) to the secondary unit 68 which may be located, for example, inside the vehicle 52. In one example, the secondary unit 68 may be adapted to provide signals received by the antenna assembly 100 to passengers associated with the vehicle. In one embodiment, the secondary unit 68 may include a second down-converter unit (DCU-2) 500. DCU-2 500 may receive input signals from the DCU 400 on lines 76 and may down-convert these signals to provide output signals of a lower frequency on lines 78. The DCU-2 500 may include a controller 502, as will be described in more detail below. The secondary unit 68 may further include additional control and power electronics 80 that may provide control signals, for example, over an RS-422 or RS-232 line 82, to the gimbal assembly 300 and may also provide operating power to the gimbal assembly 300, e.g. over line(s) 84. Secondary unit 68 may also include any necessary display or output devices (See FIG. 1*b*) to present the output signals from DCU-2 500 to passengers associated with the vehicle. For example, the vehicle 52 (FIG. 1B) may be an aircraft and the secondary unit 68 may include or be coupled to seatback displays 64 (see FIG. 1B) to provide signals, such as, for example, data, video, cellular telephone or satellite TV signals to the passengers, and may also include headphone jacks or other audio outputs to provide audio signals to the passengers. The secondary unit 68, including DCU-2 500, will be described in more detail infra.

Figure 3:
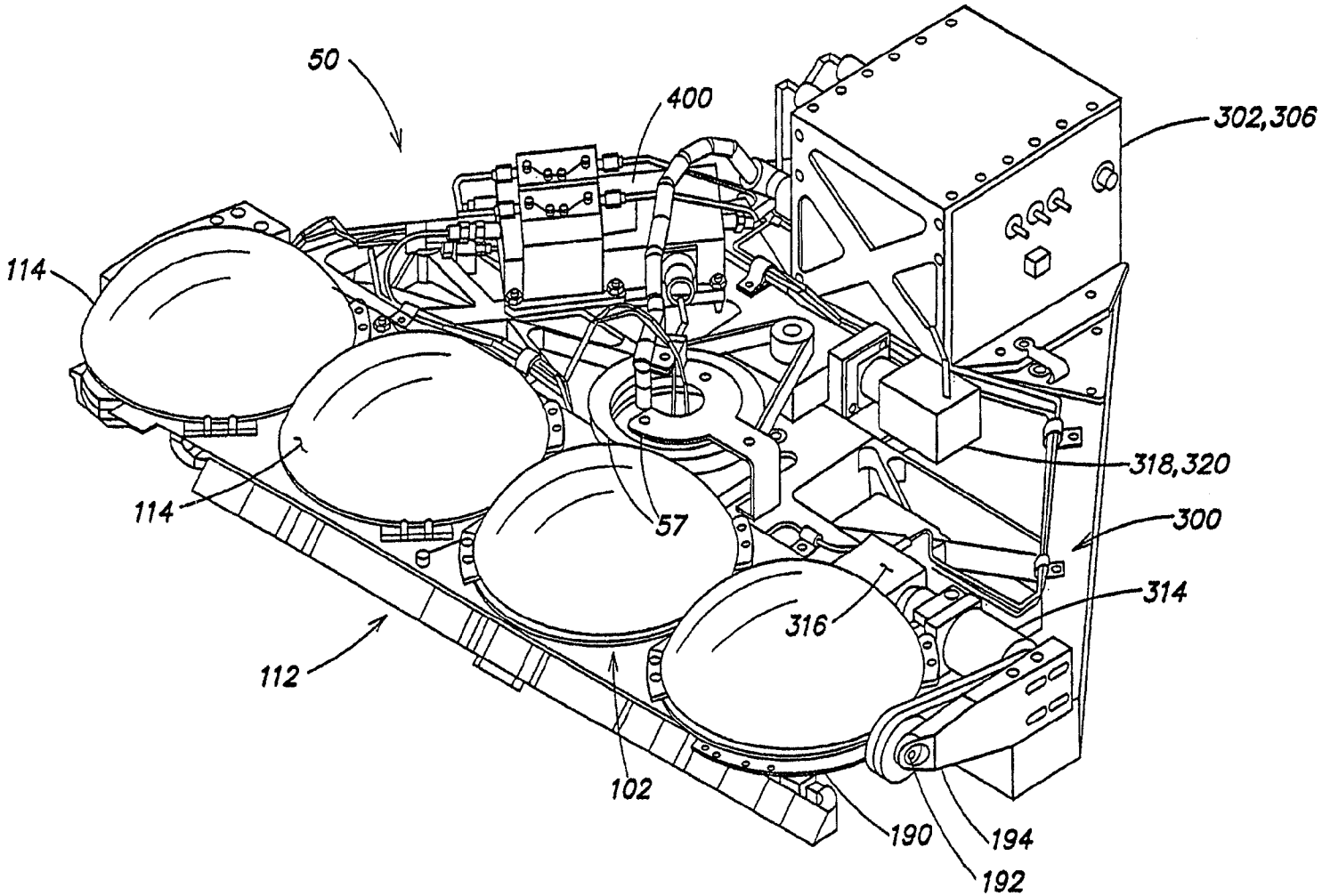
FIG. 3 is a perspective view of one embodiment of a mountable subsystem including an antenna array according to the invention.

Referring to FIG. 3, there is illustrated, in perspective view, one embodiment of the mountable subsystem 50 including one example of an antenna array 102. In the illustrated example, the antenna array 102 comprises an array of four circular horn antennas 110 coupled to a feed network 112. However, it is to be appreciated that antenna 102 may include any number of antenna elements each of which may be any type of suitable antenna. For example, an alternative antenna array may include eight rectangular horn antennas in a 2×4 or 1×8 configuration, with a suitable feed structure. Although in some applications it may be advantageous for the antenna elements to be antennas having a wide bandwidth, such as, for example, horn antennas, the invention is not limited to horn antennas and any suitable antenna may be used. It is further to be appreciated that although the illustrated example is a linear, 1×4 array of circular horn antennas 110, the invention is not so limited, and the antenna array 102 may instead include a two-dimensional array of antenna elements, such as, for example, two rows of eight antennas to form a 2×8 array. Although the following discussion will refer primarily to the illustrated example of a 1×4 array of circular horn antennas 110, it is to be understood that the discussion applies equally to other types and sizes of arrays, with modifications that may be apparent to those of skill in the art.

Figure 4:
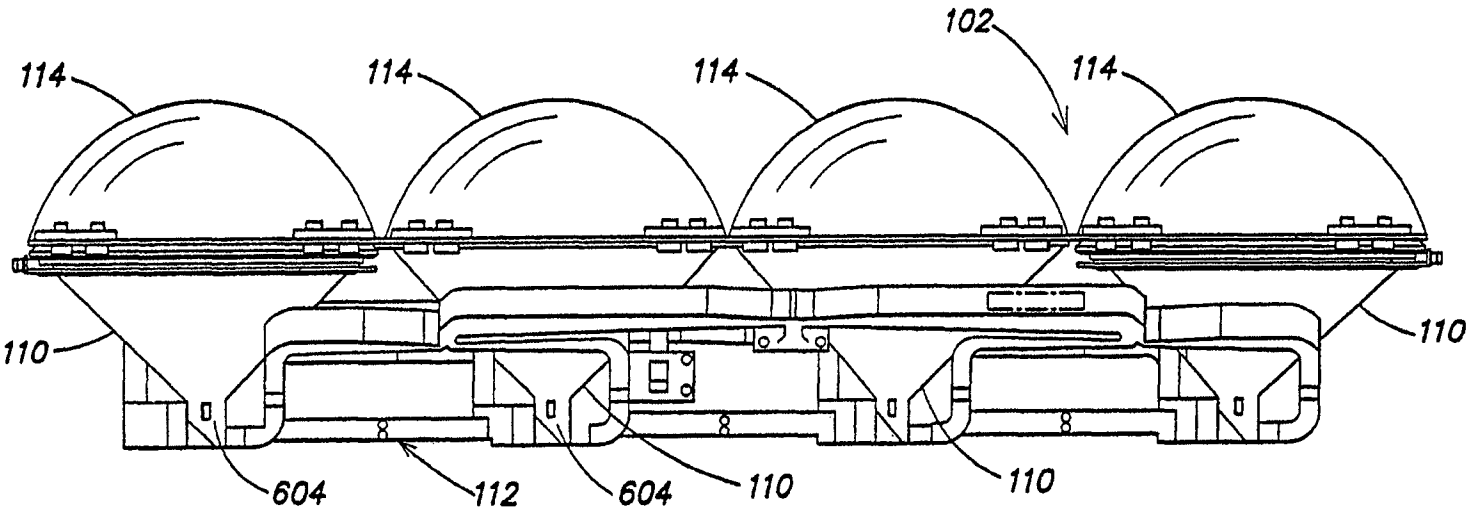
FIG. 4 is a perspective view of one embodiment of an antenna array and feed network according to the invention.

Referring to FIG. 4, there is illustrated in side view the antenna array 102 of FIG. 3, including four circular horn antennas 100, each coupled to the feed network 112. One advantage of circular horn antennas is that a circular horn antenna having a same aperture area as a corresponding rectangular horn antenna uses less space than the rectangular horn antenna. It may therefore be advantageous to use circular horn antennas in applications where the space requirement is critical. In the illustrated embodiment, the feed network 112 is a waveguide feed network. An advantage of waveguide is that it is generally less lossy than other transmission media such as cable or microstrip. It may therefore be advantageous to use waveguide for the feed network 112 in applications where it may be desirable to reduce or minimize loss associated with the antenna array 102. The feed network 112 will be described in more detail infra. Additionally, in the illustrated example, each antenna 110 is coupled to a corresponding dielectric lens 114. The dielectric lenses may serve to focus incoming or transmitted radiation to and from the antennas 110 and to enhance the gain of the antennas 110, as will be discussed in more detail infra.

Figure 5:
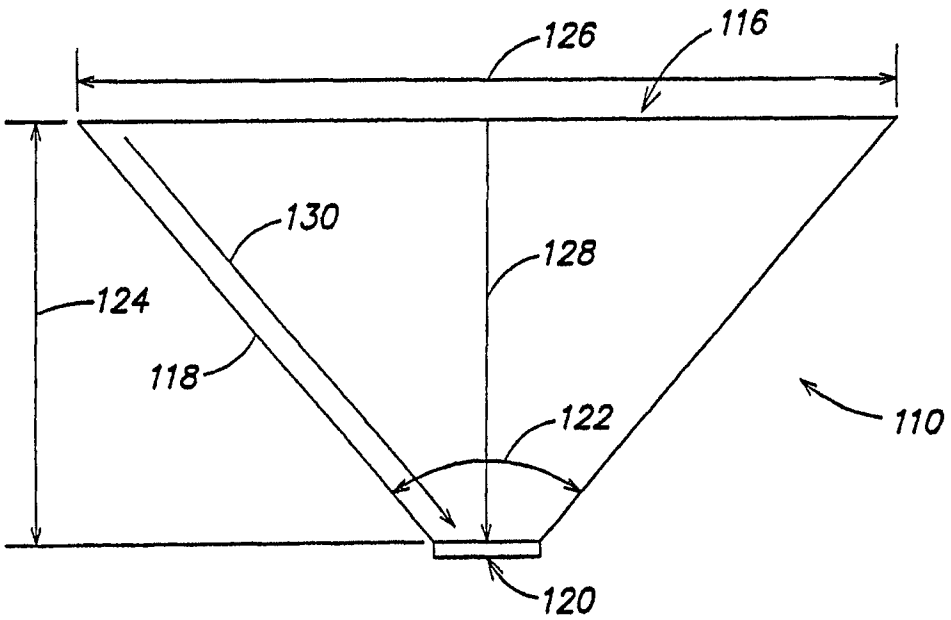
FIG. 5 is a schematic diagram of one embodiment of a horn antenna forming part of the antenna array of FIG. 4.

In general, each horn antenna 110 may receive incoming electromagnetic radiation though an aperture 116 defined by the sides of the antenna 110, as shown in FIG. 5. The antenna 110 may focus the received radiation to a feed point 120 where the antenna 110 is coupled to the feed network 112. It is to be appreciated that while the antenna array will be further discussed herein primarily in terms of receiving incoming radiation from an information source, the antenna array may also operate in a transmitting mode wherein the feed network 112 provides a signal to each antenna 110, via the corresponding feed point 120, and the antennas 110 transmit the signal.

According to one embodiment, the antenna assembly 100 may be mounted on a vehicle 52 (as shown in FIGS. 1A & 1B). In this application, it may be desirable to reduce the height of the antenna assembly 100 to minimize drag as the vehicle moves and thus to use low-profile antennas. Therefore, in one example, the horn antennas 110 may be constructed to have a relatively wide internal angle 122 to provide a large aperture area while keeping the height 124 of the horn antenna 110 relatively small. For example, according to one embodiment the antenna array may comprise an array of four horn antennas 110 (as shown in FIG. 5), each horn antenna 110 having an aperture 116 with a diameter 126 of approximately 7 inches and a height 124 of approximately 3.6 inches. In another example, the antenna assembly 100 may be mounted, for example, on the tail of an aircraft. In this case, it may be possible for the antenna(s) to have an increased height, for example, up to approximately 12 inches. In this case, the larger antenna may have significantly higher gain and therefore it may be possible to use an antenna array having fewer elements than an array of the shorter horn antennas.

As described above, because of height and/or space constraints on the antenna array, it may in some applications be desirable to use a low-height, wide aperture horn antenna 110. However, such a horn antenna may have a lower gain than is desirable because, as shown in FIG. 5, there may be a significant path length difference between a first signal 128 vertically incident on the horn aperture 116, and a second signal 130 incident along the edge 118 of the antenna. This path length difference may result in significant phase difference between the first and second signals 128, 130. Therefore, according to one embodiment, it may be desirable to couple a dielectric lens 114 to the horn antenna 110, as shown in FIG. 4, to match the phase and path length, thereby increasing the gain of the antenna array 102.

According to one embodiment, the dielectric lens 114 may be a plano-convex lens that may be mounted above and/or partially within the horn antenna aperture, as shown in FIG. 4. For the purposes of this specification, a plano-convex lens is defined as a lens having one substantially flat surface and an opposing convex surface. The dielectric lens 114 may be shaped in accordance with known optic principals including, for example, diffraction in accordance with Snell's Law, so that the lens may focus incoming radiation to the feed point 120 of the horn antenna 100. Referring to FIGS. 4 and 5, it can be seen that the convex shape of the dielectric lens 114 results in a greater vertical depth of dielectric material being present above a center of the horn aperture compared with the edges of the horn. Thus, a vertically incident signal, such as the first signal 128 (FIG. 5) may pass through a greater amount of dielectric material than does the second signal 130 incident along the edge 118 of the horn antenna 110. Because electromagnetic signals travel more slowly through dielectric than through air, the shape of the dielectric lens 114 may thus be used to equalize the electrical path length of the first and second incident signals 128, 130. By reducing phase mismatch between signals incident on the horn antenna 110 from different angles, the dielectric lens 114 may serve to increase the gain of the horn antenna 110.

Referring to FIGS. 6A-D, there is illustrated, in different views, one embodiment of a dielectric lens 114 according to the invention. In the illustrated example, the dielectric lens 114 is a plano-convex lens. The simple convex-plano shape of the lens may provide focus, while also providing for a compact lens-antenna combination. However, it is to be appreciated that the dielectric lens 114 may have any shape as desired, and is not limited to a plano-convex lens.

According to one embodiment, the lens may be constructed from a dielectric material and may have impedance matching concentric grooves formed therein, as shown in FIGS. 6A-D. The dielectric material of the lens may be selected based, at least in part, on a known dielectric constant and loss tangent value of the material. For example, in many applications it may be desirable to reduce or minimize loss in the mountable subsystem and thus it may be desirable to select a material for the lens having a low loss tangent. Size and weight restrictions on the antenna array may, at least in part, determine a range for the dielectric constant of the material because, in general, the lower the dielectric constant of the material, the larger the lens may be.

The outside surface of the lens may be created by, for example, milling a solid block of lens material and thereby forming the convex-plano lens. As discussed above, according to one example, the external surface of the lens may include a plurality of grooves 132, forming a plurality of concentric rings about the center axis of the lens. The grooves contribute to improving the impedance match of the lens to the surrounding air, and thereby to reduce the reflected component of received signals, further increasing the antenna-lens efficiency. The concentric grooves 132, of which there may be either an even or odd number in total, may be, in one example, evenly spaced, and may be easily machined into the lens material using standard milling techniques and practices. In one example, the grooves may be machines so that they have a substantially identical width, for ease of machining.

The concentric grooves 132 may facilitate impedance matching the dielectric lens 114 to surrounding air. This may reduce unwanted reflections of incident radiation from the surface of the lens. Reflections may typically result from an impedance mismatch between the air medium and the lens medium. In dry air, the characteristic impedance of free space (or dry air) is known to be approximately 377 Ohms. For the lens material, the characteristic impedance is inversely proportional to the square root of the dielectric constant of the lens material. Thus, the higher the dielectric constant of the lens material, the greater, in general, the impedance mismatch between the lens and the air. In some applications it may be desirable to manufacture the lens from a material having a relatively high dielectric constant in order to reduce the size and weight of the lens. However, reflections resulting from the impedance mismatch between the lens and the air may be undesirable.

The dielectric constant of the lens material is a characteristic quantity of a given dielectric substance, sometimes called the relative permittivity. In general, the dielectric constant is a complex number, containing a real part that represents the material's reflective surface properties, also referred to as Fresnel reflection coefficients, and an imaginary part that represents the material's radio absorption properties. The closer the permittivity of the lens material is relative to air, the lower the percentage of a received communication signal that is reflected.

The magnitude of the reflected signal may be significantly reduced by the presence of impedance matching features such as the concentric rings machined into the lens material. With the grooves 132, the reflected signal at the surface of the lens material may be decreased as a function of $\eta_n$, the refractive indices at each boundary, according to equation 1 below:

$$\frac{(\eta_2 - \eta_1)}{(\eta_2 + \eta_1)} \tag{1}$$

A further reduction in the reflected signal may be obtained by optimizing the depth of the grooves such that direct and internally reflected signals add constructively.

Figure 6A:
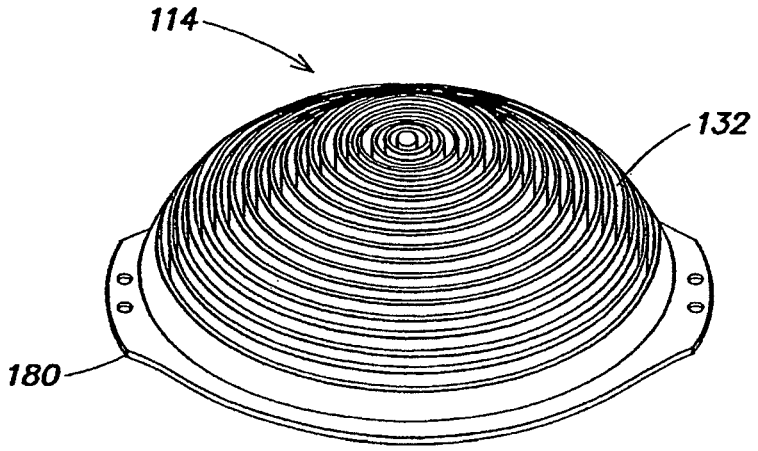
FIG. 6A is an isometric view of one embodiment of a dielectric lens according to the invention.
Figure 6B:
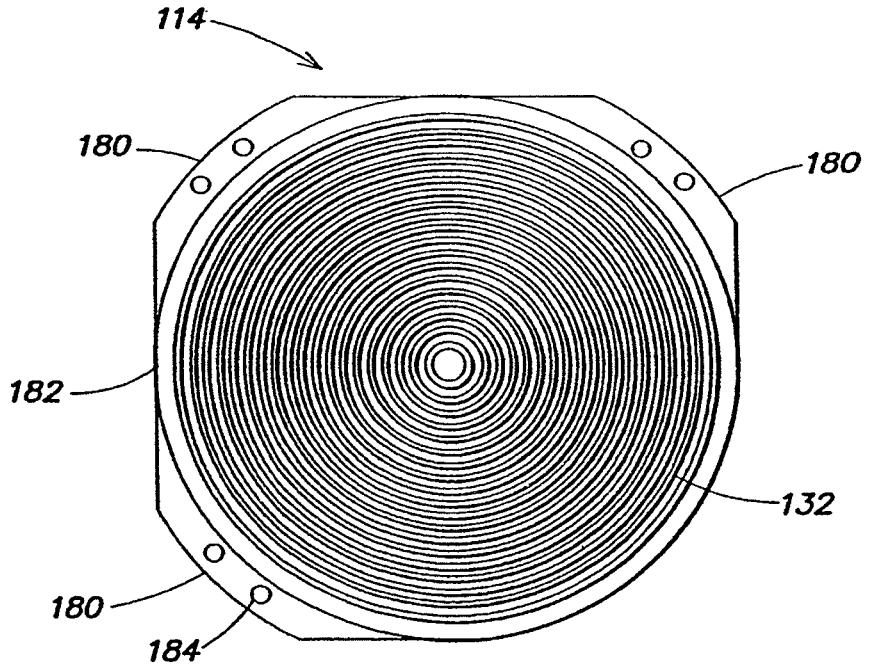
FIG. 6B is a top view of the dielectric lens of FIG. 6A.
Figure 6C:
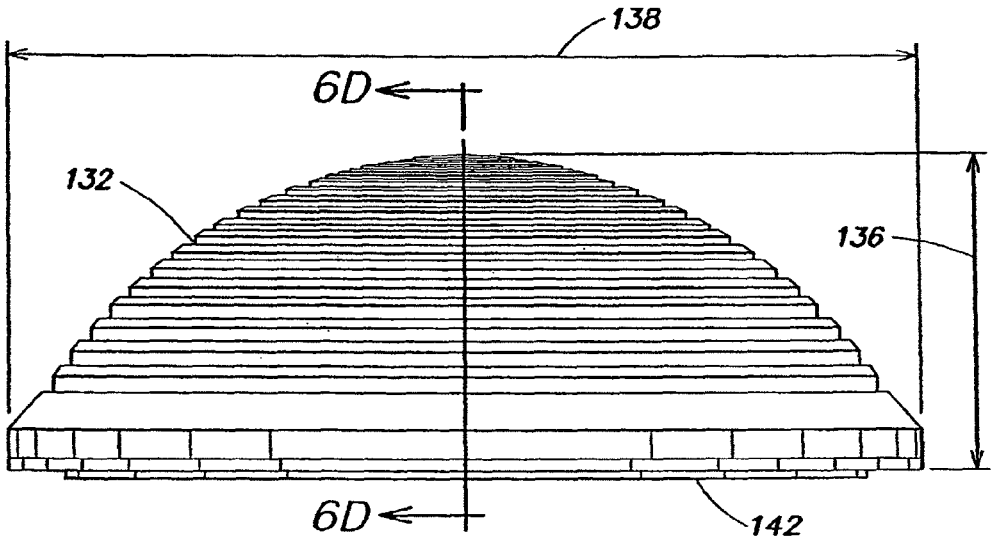
FIG. 6C is a side view of the dielectric lens of FIG. 6B.
Figure 6D:
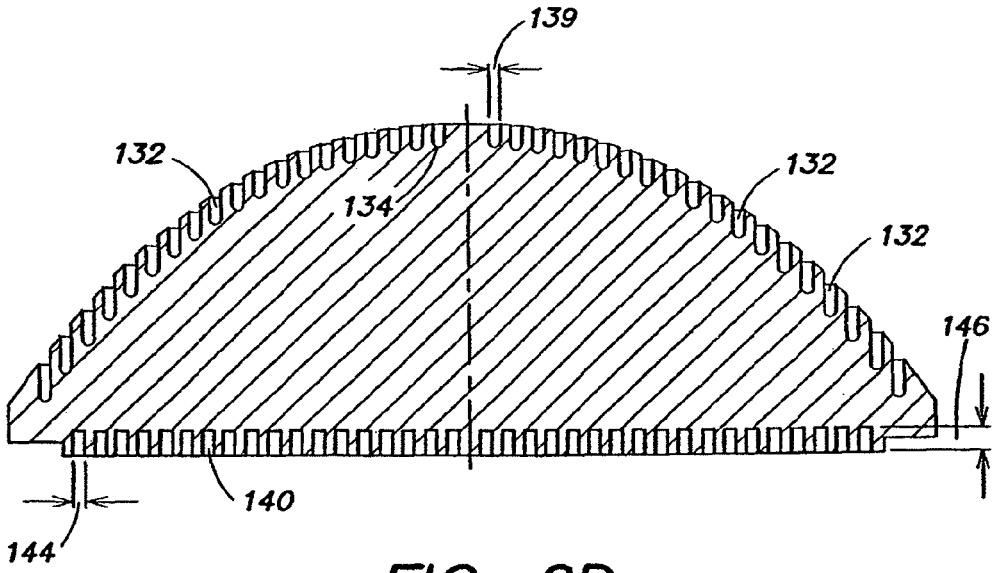
FIG. 6D is a cross-sectional view of the dielectric lens of FIG. 6C taken along line D-D in FIG. 6C.

Referring to FIG. 6D, each of the concentric grooves 132 may have a concave surface feature at a greatest depth of the groove where the groove may taper to a dull point 134 on the inside of the lens structure. The concentric grooves may be formed in the lens using common milling or lathe operations, for example, with each groove being parallel to the center axis of the lens for ease of machining. In other words, each groove may be formed parallel to each other groove on the face of the lens. Thus, while both the width and the angle of the concentric grooves may remain constant, the depth to which each of the concentric grooves is milled may increase the farther a concentric groove is located from the apex, or center, of the convex lens, as shown in FIG. 6D. In one example, the grooves may typically have a width 138 of approximately one tenth of a wavelength (at the center of the operating frequency range) or less. The depth of the grooves may be approximately one quarter wavelength for the dielectric constant of the grooved material. The percentage of grooved material is determined from the equation 2 below:

$$\frac{\left(\eta - \eta^{\frac{1}{2}}\right)}{(\eta - 1)} \tag{2}$$

where $\eta$ is the refractive index of the lens dielectric material.

The size of the lens and of the grooves formed in the lens surface may be dependent on the desired operating frequency of the dielectric lens 114. In one specific example, a dielectric lens 114 designed for use in the Ku frequency band (10.70-12.75 GHz) may have a height 136 of approximately 2.575 inches, and diameter 138 of approximately 7.020 inches. In this example, the grooves 132 may have a width 139 of approximately 0.094 inches and the concavity 134 formed at the base of each of these grooves may have a radius of approximately 0.047 inches. As illustrated in FIG. 6D, in this example, the lens 114 may possess a total of nineteen concentric grooves. In one example, the grooves may penetrate the surface by approximately one quarter-wavelength in depth near the center axis and may be regularly spaced to maintain the coherent summing of the direct and internally reflected signals, becoming successively deeper as the grooves approach the periphery of the lens. According to one specific example, the center-most concentric groove may have, for example, a depth of 0.200 inches, and the outermost groove may have, for example, a depth of 0.248 inches. The grooves may be evenly spaced apart at gaps of approximately 0.168 inches from the center of the lens. Of course, it is to be appreciated that the specific dimensions discussed above are one example given for the purposes of illustration and explanation and that the invention is not limited with respect to size and number or placement of grooves. Although the illustrated example includes nineteen grooves, the dielectric lens 114 may be formed with more or fewer than 19 grooves and the depths of the grooves may also be proportional to the diameter of the lens, and may be based on the operating frequency of the dielectric lens.

Conventional impedance matching features on dielectric lenses may require the insertion of a large number of holes regularly spaced, for example, every one half wavelength. For example, the quantity of holes using a hole spacing of 0.34 inches along radials 0.34 inches apart is 337, for a 7 inch diameter lens, whereas a grooved dielectric lens according to the invention may include only 19 grooves. The invention may thus eliminate the need to form hundreds of holes, and may reduce the complexity of design and manufacture of the lens. It is further to be appreciated that while the grooves 132 have been illustrated as concentric, they may also alternatively be embodied in the form of parallel rows of grooves, or as a continuous groove, such as a spiral.

According to another embodiment, a convex-plano lens according to aspects of the invention may comprise impedance matching grooves 132, 140 formed on both the convex lens surface and the planar surface, as shown in FIG. 6D. Referring to FIG. 6C, according to one example, a planar side 142 may be formed opposite the convex side of the lens. A diameter of the planar side 142 may be reduced relative to the overall diameter of the lens by, for example, milling. The reduced diameter of planar side 142 allows for the lens to be partially inserted into the horn antenna. According to one specific example, the dielectric lens 114 may have a radius of approximately 3.500 inches. Outside a radius of approximately 3.100 inches on the non-convex side of the lens structure from its center, the planar side 142 is formed to reduce the overall height of the lens by approximately 0.100 of an inch, as shown in FIG. 6C. Accordingly, a portion of the outermost edge of the planar side of the lens measuring approximately 0.400 inches in length and 0.100 inches in height is removed. From the center-most point of the planar side to a radius of, for example, 3.100 inches, concentric grooves 140 may be milled into the planar surface 142 of the lens, similar to the grooves 132 which are milled on the convex, or opposite, side of the lens structure.

In one example, illustrated in FIG. 6D, the concentric interior grooves 140 may be uniform with a constant width 144, for example of 0.094 inches, and a constant depth 146, for example of 0.200 inches. However, it is to be understood that the grooves need not be uniform and may have varying widths and depths depending on desired characteristics of the lens. Unlike the exterior grooves 132, the interior grooves 140 may not vary in depth the farther each groove is from the center of the lens. In one example, half the height of the peak of the interior grooves 140 extends beyond the exterior 0.400 inches of the planar base of the lens, while half the valley, or trough, of each milled groove extends farther into the lens beyond the outer-most 0.400 inches of the planar base of the lens. It is further to be appreciated that the invention is not limited to the particular dimensions of the examples discussed herein, which are for the purposes of illustration and explanation and not intended to be limiting.

Referring again to FIG. 6D, when the concentric grooves 132 are formed on the convex side of the lens 114, the otherwise smooth lens surface is rendered into concentric volumetric rings of varying height. These rings possess peaks and valleys. The peaks may be jagged, given the overall curve of convex shape, while the valleys may have a rounded bottom or base 134 where they terminate, as discussed above. As shown in FIG. 6D, each concentric circular groove moving away from the center of the lens possesses a more triangular peak than previous (more centered) grooves due to the general curve of the exterior surface of the lens. The interior grooves 140 on the planar side of the lens, however, may have more regular peaks and valleys.

According to the illustrated embodiment, the concentric grooves 132 on the convex side of the lens may not be perfectly aligned with the concentric grooves 140 on the planar side of the lens, but instead may be offset as shown in FIG. 6D. For example, every peak on the exterior, convex of the lens may be aligned to a trough or valley on the interior, planar side. Conversely, every peak on the interior of the lens may be offset by a trough that is milled into the exterior of the lens. The illustrated example, having grooves on the planar and convex sides of the lens may reduce the reflected RF energy by approximately 0.23 dB, roughly half of the 0.46 dB reflected by a similarly-sized and material non-grooved lens.

According to another embodiment, a plano-convex dielectric lens may include a single zone Fresnel-like surface feature formed along an interior face of the convex lens. In combination with grooves on the exterior and interior surfaces of the plano-convex lens (as discussed above), the Fresnel-like feature may contribute to greatly reduce the volume of the lens material, thereby lowering the overall weight of the lens. As discussed above, one application for the lens is in combination with an antenna mounted to a passenger vehicle, for example, an airplane, to receive broadcast satellite services. In such as application, the total weight of the lens and antenna may be an important design consideration, with a lighter structure being preferred. The overall weight of the lens may be reduced significantly by the incorporation of a single Fresnel-like zone into the inner planar surface of a plano-convex lens.

Figure 7:
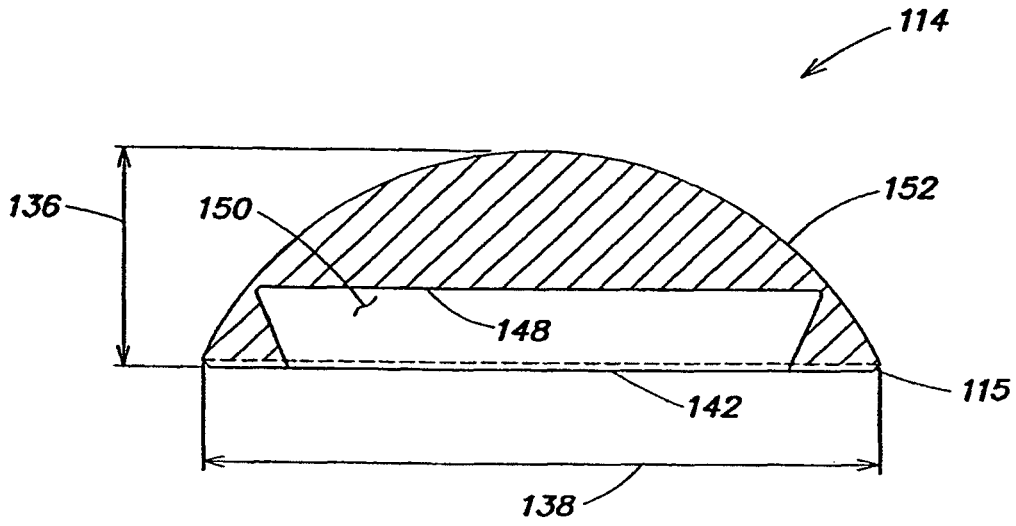
FIG. 7 is a cross-sectional diagram of one embodiment of a dielectric lens including a Fresnel-like feature, according to the invention.

Referring to FIG. 7, a plano-convex lens may be designed starting with a small (close to zero) thickness at the edge of the lens with the thickness being progressively being increased toward the lens center axis, as required by the phase condition, i.e., so that all signal passing through the lens at different angles of incidence will arrive at the feed point of the antenna approximately in phase. In order to satisfy the phase condition, the path length difference between a perimeter lens signal and an interior lens signal may be equal to a one wavelength, at the operating frequency. At this point the dielectric material thickness can be reduced to a minimum structural length, or nearly zero, without altering the wavefronts traveling through the lens. This point then may form the outer boundary 148 of another planar zone parallel to the original planar surface 142, through which the optical path lengths are one wavelength less than those through the outermost zone, as shown in FIG. 7. The use of multiple Fresnel-like zones may limit the frequency bandwidth for reception or transmission of signals, for example in the 10.7 to 12.75 GHz band, and therefore only one large Fresnel-like zone may be preferred. However, it is to be appreciated that in applications where large bandwidth is not important, a dielectric lens according to the invention may be formed with more than one Fresnel-like zone and the invention is not limited to a lens comprising only a single Fresnel-like zone.

According to one embodiment, illustrated in FIG. 7, the Fresnel-like feature 150 may be a "cut-out" in the lens material, approximately trapezoidal in shape and extending from the planar surface 142 of the lens toward the outer convex surface 152 of the lens. The Fresnel-like feature 150 may provide a significant weight reduction. For example, compared to a lens of similar dimensions formed of a solid polystyrene material, the lens illustrated in FIG. 7 represents a 44% weight savings due to the material removed in the Fresnel-like zone. The reduction in dielectric material, which absorbs radio frequency energy, also may result in the lens having a higher efficiency because less radio frequency energy may be absorbed as signals travel through the lens. For example, the lens depicted in FIG. 7 may absorb approximately 0.05 dB less energy when compared to a convex plano lens that does not have the single Fresnel-like zone. The attenuation of the signal through the lens may be computed according to the equation 3 below:

$$\alpha(\text{dB/inch}) = \frac{(losst)8.68\pi\sqrt{\varepsilon}}{\lambda} \tag{3}$$

where, $\alpha$ is attenuation in dB/inch, "losst" is the loss tangent of the material, $\in$ is the dielectric constant of the material, and $\lambda$ is the free space wavelength of the signal.

Figure 8:
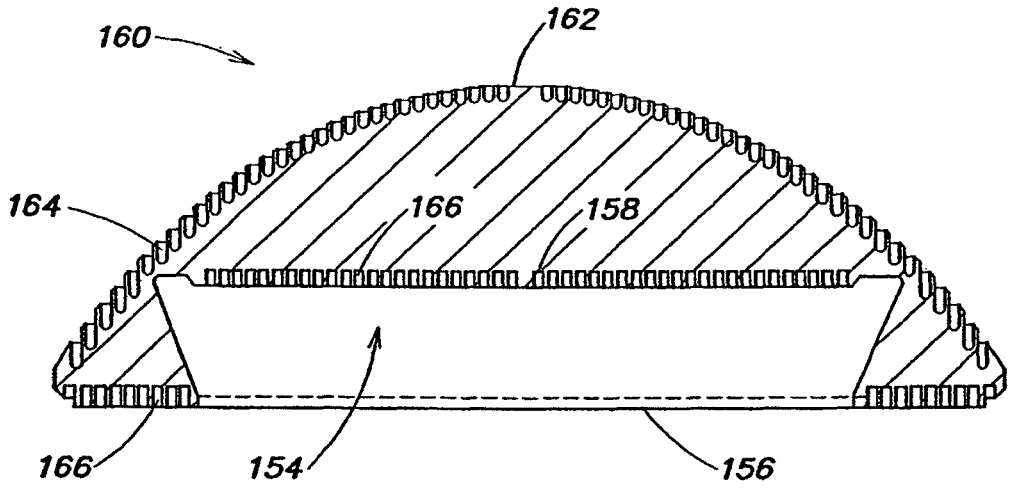
FIG. 8 is a diagram of another embodiment of a grooved dielectric lens including a internal-step Fresnel feature, according to the invention.

Referring to FIG. 8, there is illustrated another example of a dielectric lens that includes a single zone Fresnel-like feature 154 formed extending inward from adjacent the interior planar surface 156 of the lens. As discussed above, the Fresnel-like zone may greatly reduce the volume of the lens material, thereby lowering the overall lens weight. This structure illustrated in FIG. 8 may also be referred to as an internal-step Fresnel lens 160. In one embodiment, the internal-step Fresnel lens 160 may have impedance matching grooves formed therein, as illustrated. In one example, an external convex surface 162 of the lens 160 may have one or more impedance matching grooves 164 formed as concentric rings, as discussed above. The interior planar surface 156 may similarly have one or more grooves 166 formed therein as concentric rings, as discussed above. According to one embodiment, an upper planar surface 158, forming an upper boundary of the Fresnel-like feature 154, may also have one or more grooves 166 formed therein, as illustrated in FIG. 8. The grooves may contribute to improve the impedance matching of the lens 160 and to reduce reflected losses at the convex surface 162, at the Fresnel-like surface 158 and again at the remaining planar surface 156, to further increase the antenna-lens efficiency.

Figure 9:
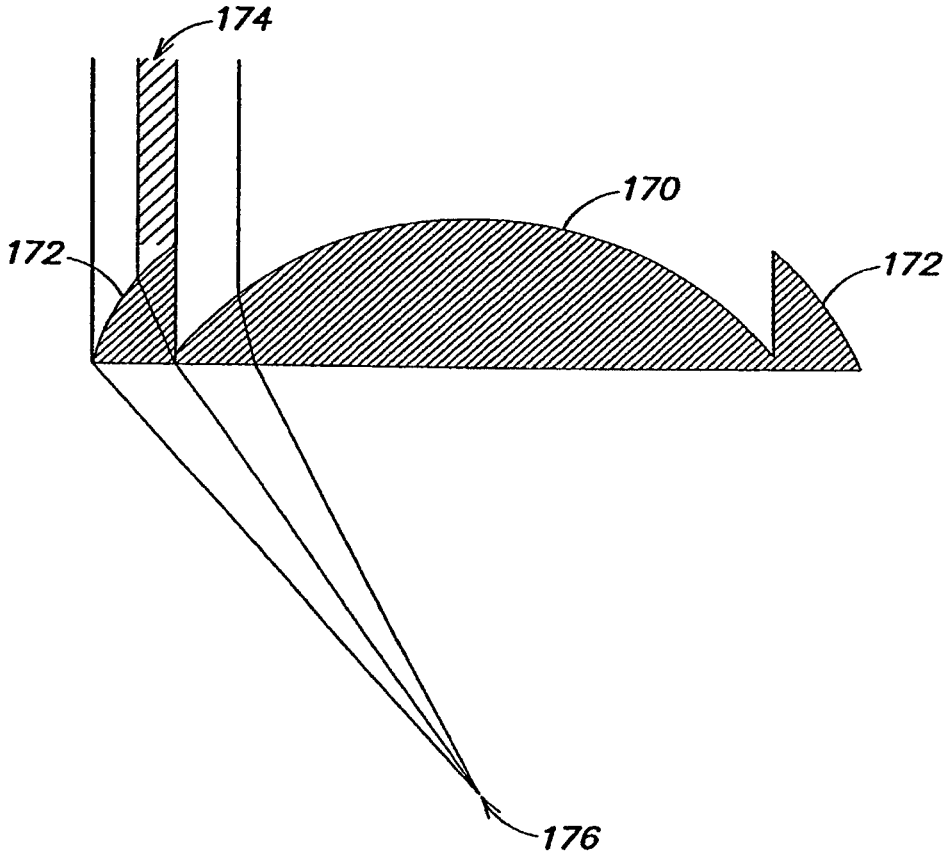
FIG. 9 (RELATED ART)
FIG. 9 is a schematic diagram of a conventional Fresnel lens.
Figure 10:
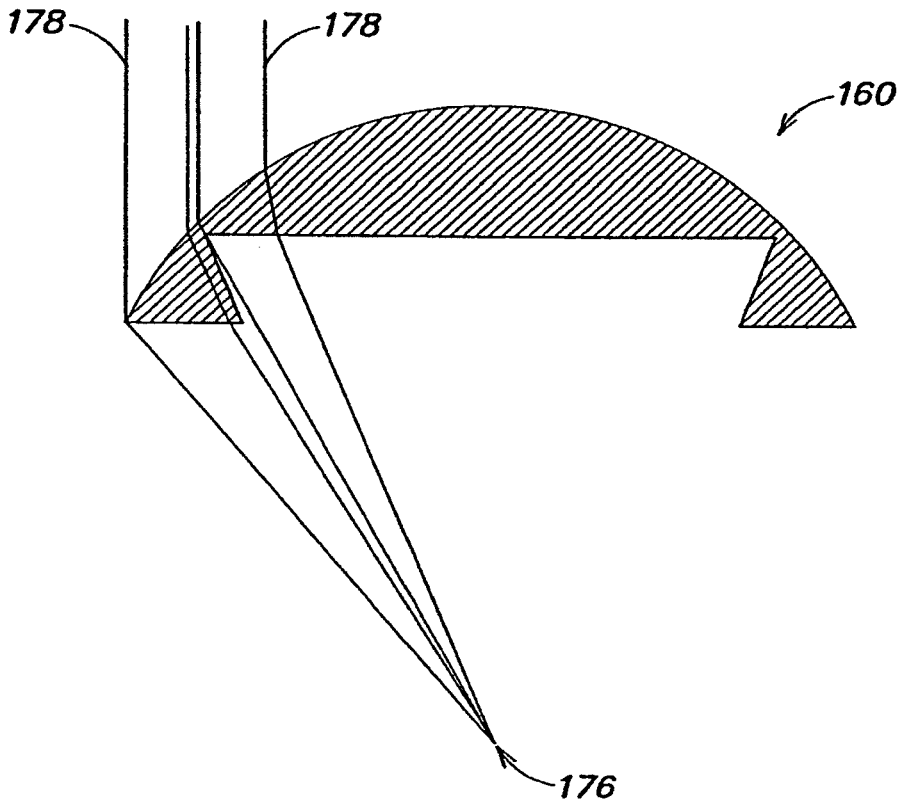
FIG. 10. is a schematic diagram of a internal-step Fresnel lens according to the invention.

A conventional Fresnel lens 170 is illustrated in FIG. 9. As shown in FIG. 9, the conventional Fresnel lens places step portions 172 on the outer surface (away from a coupled horn antenna) of the lens, which has inherent inefficiencies. In particular, radiation incident on certain portions, shown by area 174, of the conventional Fresnel lens 170 is not directed to a focal point 176 of the lens. By contrast, the internal-step Fresnel lens 160 of the invention focuses radiation 178 incident on any part of the outer surface of the lens to the focal point of the lens, as illustrated in FIG. 10. The internal-step Fresnel lens of the invention, when used in combination with a conical horn antenna, may thus be a more efficient replacement for a conventional reflective dish antenna than a conventional Fresnel lenses. As discussed above, the internal-step Fresnel lens may provide considerable weight savings compared to an ordinary plano-convex lens. Furthermore, the internal-step Fresnel lens does not increase the "swept volume" of a horn-lens combination compared to a standard Fresnel lens, for rotating antenna applications.

Figure 11:
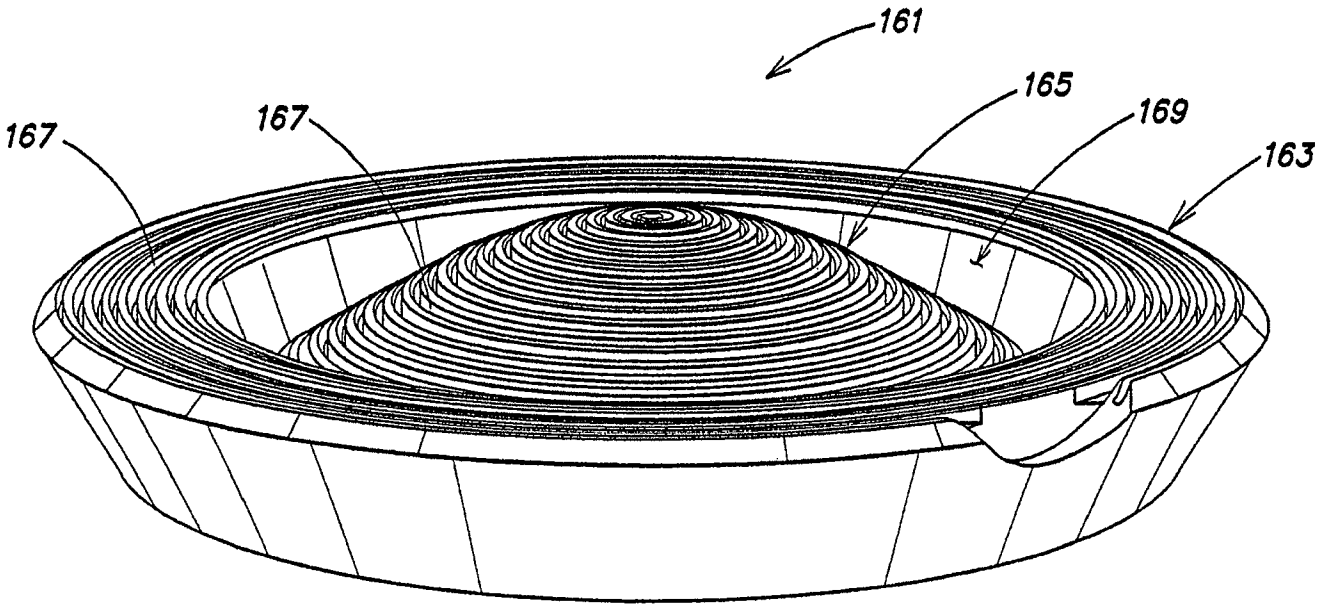
FIG. 11 is an illustration of another embodiment of a dielectric lens according to the invention.

Referring to FIG. 11, there is illustrated another embodiment of a dielectric lens 161 according to the invention. In this embodiment, the dielectric lens 161 uses a plano-convex shape for a perimeter lens surface 163 and a bi-convex lens shape for an interior lens surface 165. Each of the perimeter surface 163 and the interior surface 165 may have one or more grooves 167 formed therein, as discussed above. In addition, the dielectric lens 161 may have a Fresnel-like feature 169 formed therein, as discussed above to reduce the weight of the lens 161. An optimum refractive plano- or bi-convex structure may be achieved by using a deterministic surface for one side of the lens 161 (e.g., a planar, spherical, parabolic or hyperbolic surface) and solving for the locus of points for the opposite surface. In the illustrated embodiment, the bi-convex portion 165 is designed with a spherical surface on one side of the lens and an optimized locus on the other side.

As discussed above, the dielectric lenses may be designed to have an optimal combination of weight, dielectric constant, loss tangent, and a refractive index that is stable across a large temperature range. It may also be desirable that the lens will not deform or warp as a result of exposure to large temperature ranges or during fabrication, and will absorb only very small amounts, e.g., less than 1%, of moisture or water when exposed to humid conditions, such that any absorbed moisture will not adversely affect the combination of dielectric constant, loss tangent, and refractive index of the lens. Furthermore, for affordability, it may be desirable that the lens be easily fabricated. In addition, it may be desirable that the lens should be able to maintain its dielectric constant, loss tangent, and a refractive index and chemically resist alkalis, alcohols, aliphatic hydrocarbons and mineral acids.

According to one embodiment, a dielectric lens may be constructed using a certain form of polystyrene that is affordable to make, resistant to physical shock, and can operate in the thermal conditions such as −70 F. In one example, this material may be a rigid form of polystyrene known as crossed-linked polystyrene. Polystyrene formed with high cross linking, for example, 20% or more cross-linking, may be formed into a highly rigid structure whose shape may not be affected by solvents and which also may have a low dielectric constant, low loss tangent, and low index of refraction. In one example, a cross-linked polymer polystyrene may have the following characteristics: a dielectric constant of approximately 2.5, a loss tangent of less than 0.0007, a moisture absorption of less than 0.1%, and low plastic deformation property. Polymers such as polystyrene can be formed with low dielectric loss and may have non-polar or substantially non-polar constituents, and thermoplastic elastomers with thermoplastic and elastomeric polymeric components. The term "non-polar" refers to monomeric units that are free from dipoles or in which the dipoles are substantially vectorially balanced. In these polymeric materials, the dielectric properties are principally a result of electronic polarization effects. For example, a 1% or 2% divinylbenzene and styrene mixture may be polymerized through radical reaction to give a crossed linked polymer that may provide a low-loss dielectric material to form the thermoplastic polymeric component. Polystyrene may be comprised of, for example, the following polar or non-polar monomeric units: styrene, alpha-methylstyrene, olefins, halogenated olefins, sulfones, urethanes, esters, amides, carbonates, imides, acrylonitrile, and co-polymers and mixtures thereof. Non-polar monomeric units such as, for example, styrene and alpha-methylstyrene, and olefins such as propylene and ethylene, and copolymers and mixtures thereof, may also be used. The thermoplastic polymeric component may be selected from polystyrene, poly(alpha-methylstyrene), and polyolefins.

A lens constructed from a cross-linked polymer polystyrene, such as that described above, may be easily formed using conventional machining operations, and may be grinded to surface accuracies of less than approximately 0.0002 inches. The cross-linked polymer polystyrene may maintain its dielectric constant within 2% down to temperatures exceeding the −70 F, and may also have a chemically resistant material property that is resistant to alkalis, alcohols, aliphatic hydrocarbons and mineral acids. In one example, the dielectric lens so formed may include the grooved surfaces and internal-step Fresnel feature discussed above.

In one example, the dielectric lens may be formed of a combination of a low loss lens material, which may be cross-linked polystyrene, and thermosetting resins, for example, cast from monomer sheets & rods. One example of such a material is known as Rexolite®. Rexolite® is a unique cross-linked polystyrene microwave plastic made by C-Lec Plastics, Inc. Rexolite® maintains a dielectric constant of 2.53 through 500 GHz with extremely low dissipation factors. Rexolite® exhibits no permanent deformation or plastic flow under normal loads. All casting may be stress-free, and may not require stress relieving prior to, during or after machining. During one test, Rexolite® was found to absorb less than 0.08% of moisture after having been immersed in boiling water for 1000 hours, and without significant change in dielectric constant. The tool configurations used to machine Rexolite® may be similar to those used on Acrylic. Rexolite® may thus be machined using standard technology. Due to high resistance to cold flow and inherent freedom from stress, Rexolite® may be easily machined or laser beam cut to very close tolerances, for example, accuracies of approximately 0.0001 can be obtained by grinding. Crazing may be avoided by using sharp tools and avoiding excessive heat during polishing. Rexolite® is chemically resistant to alkalis, alcohols, aliphatic hydrocarbons and mineral acids. In addition, Rexolite® is about 5% lighter than Acrylic and less than half the weight of TFE (Teflon) by volume.

Referring again to FIGS. 3 and 4, the dielectric lenses 114 may be mounted to the horn antennas 110, as illustrated. According to one embodiment, illustrated in FIGS. 6A & 6B, the lens 114 may include one or more attachment flanges 180 which may protrude from the sides of the lens 114 and may be used to attach the lens onto another surface, such as, for example, the horn antenna 110 (see FIG. 3). In one example, the lens may include three flanges 180 which may extend from the edge of the lens at 90-degree angles from one another such that one flange is located in three out of the four quadrants when the lens is viewed from a top-down perspective, as shown in FIG. 6B. According to one specific example, the flanges 180 may extend approximately 0.413 inches from the edge of the lens 114 and may have a width of approximately 0.60 inches. As stated above, the lens 114 may have a diameter of approximately 7.020 inches and a radius of approximately 3.510 inches. However, with the flanges 180, the full radius of the lens 114 may be approximately 3.9025 inches, when measuring each flange at its greatest length as each extends outward from the center of the lens. Thus, in one example, the flanges 180 may extend from the edge of the lens at their greatest point by 0.4025 inches.

Figure 12:
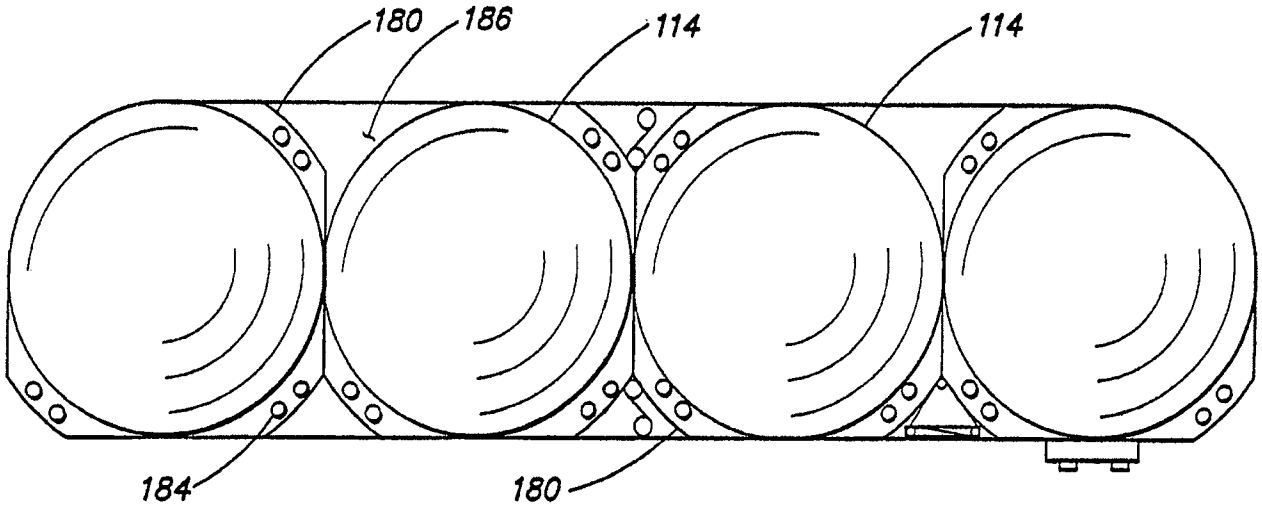
FIG. 12 is a front schematic view of one embodiment of an antenna array, according to the invention.

According to another embodiment, the flanges 180 may be tapered evenly so that at the mid-point 182 between flanges 180, no material protrudes beyond the approximate 7.020-inch diameter of the lens, as illustrated in FIG. 6B. In one example, one or more holes 184 may be formed in the flanges 180. The holes 184 may be used for attaching the lens 114 onto an external surface, such as a plate 186, as shown in FIG. 12. In one example, the holes may each have a diameter of approximately 0.22 inches. Additionally, the holes may be spaced so that they are equidistant on either side of the center of each flange.

Figure 13:
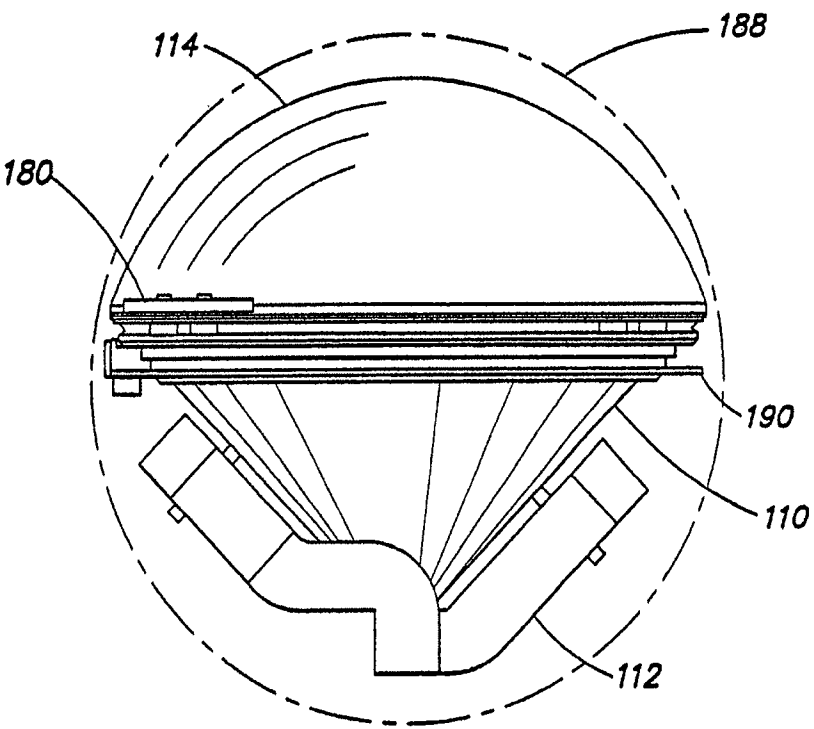
FIG. 13 is a side schematic view of another embodiment of an antenna array shown within a circle of rotation, according to the invention.

According to one example, the dielectric lens 114 may be designed to fit over, and at least partially inside, the horn antenna 110, as shown in FIG. 13. The lens 114 may be designed such that, when mounted to the horn antenna 110, the combination of the horn antenna 100 and the lens 114 may still fit within a constrained volume, such as a circle of rotation 188. In one example, a diameter of the lens 114 may be approximately equal to a diameter of the horn antenna 110, and a height of the lens 114 may be approximately half of the diameter of the horn antenna 110. According to another example, the lens 114 may be self-centering with respect to the horn antenna 110. For example, the shape of lens 114 may perform the self-centering function, such as the lens 114 may have slanted edge portions 115 (see FIG. 7) which serve to center the lens 114 with respect to the horn antenna 110. In one example, the slanted edge portions 115 of the lens may match a slant angle of the horn antenna 110. For example, if the sides of the horn antenna 110 are at a 45° angle with respect to vertical, then the slanted edge portions 115 of the lens may also be at a 45° angle with respect to vertical.

Referring again to FIG. 13, the waveguide feed network 112 may also be designed to fit within the circle of rotation 188. In another example, illustrated in FIG. 3, the mountable subsystem 50 which may also include the gimbal assembly 300 to which the horn antennas 110 and lenses 114 may be attached, and a covering radome (not shown) may be designed to fit within a constrained volume (e.g., the circle of rotation FIG. 13, 188) discussed above. In one example, the feed network 112 may be designed to fit adjacent to the curvature of the horn antenna 110, as shown, to minimize the space required for the feed network.

According to another example, the lens 114 may be designed such that a center of mass of the lens 114 acts as a counterbalance to a center of mass of the corresponding horn antenna 110 to which the lens is mounted, moving a composite center of mass of the lens and horn closer to a center of rotation of the entire structure, in order to facilitate rotation of the structure by the gimbal assembly 300.

Figure 14:
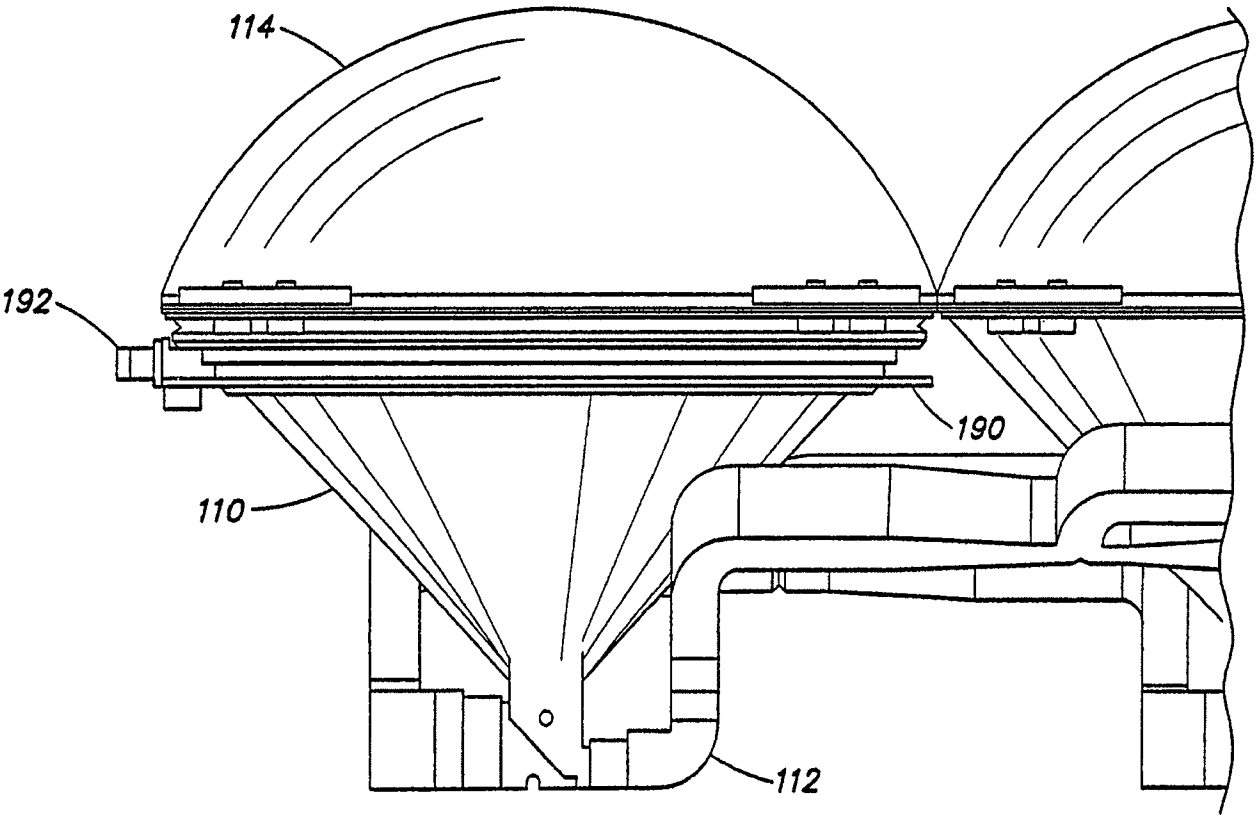
FIG. 14 is an illustration of a portion of the dielectric lens according to the invention.

Referring to FIGS. 3 and 13, according to yet another embodiment, certain of the horn antennas 110, for example those located at ends of the antenna array 102, may include a ring 190 formed on a surface of the horn antenna 110 to facilitate mounting of the horn antenna 110 to the gimbal assembly 300. As shown in FIG. 14, the ring 190 may be adapted to mate with a post 192 that is coupled to an arm 194 that extends from the gimbal assembly 300 (see FIG. 3) to mount the antenna array 102 to the gimbal assembly 300 and to enable the gimbal assembly to move the antenna array 102. The ring 190 may be formed on an outer surface of the horn antenna 110, near the aperture of the horn antenna, i.e. near a center of rotation of the antenna array, as shown in FIG. 13. In one example, the ring 190 may be integrally formed with the horn antenna 110.

Figure 15:
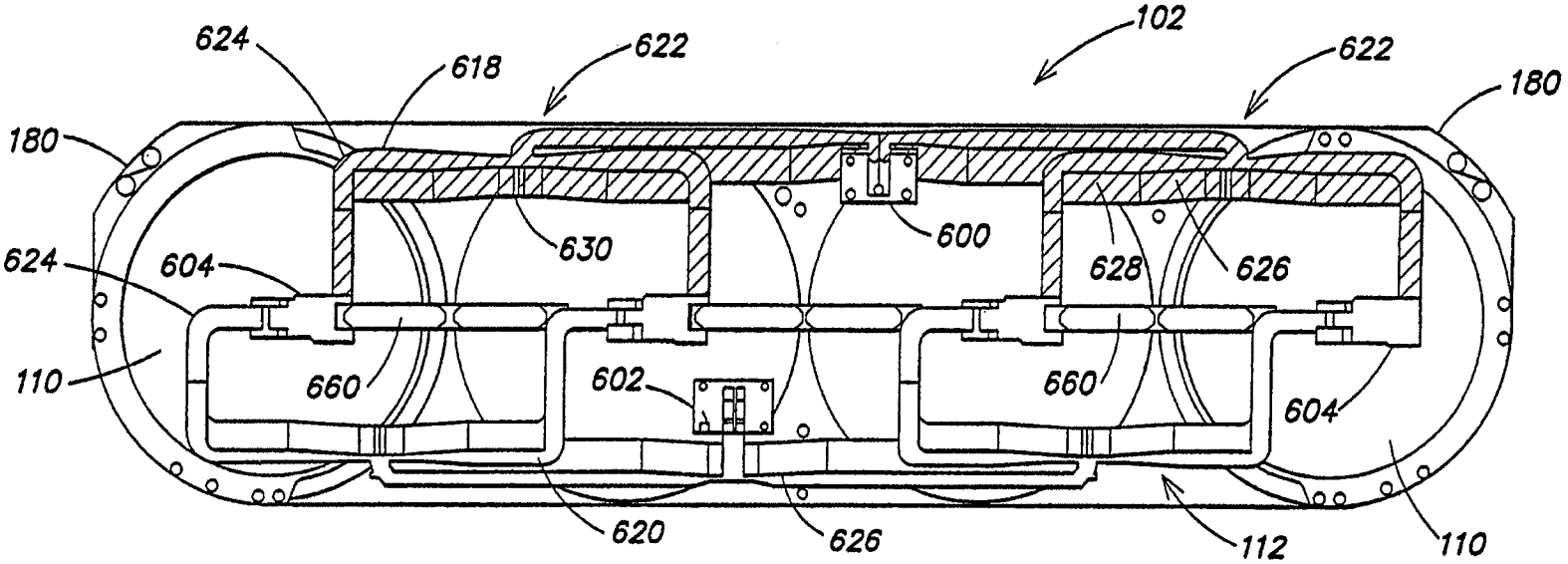
FIG. 15 is a back schematic view of one embodiment of an antenna array illustrating an example of a waveguide feed network according to the invention.

As discussed above, the antenna array 102 includes a feed network 112 that, according to one embodiment, may be a waveguide feed network 112, as illustrated in FIG. 15. The feed network 112 may operate, when the antenna array 102 is in receive mode, to receive signals from each of the horn antennas 110 and to provide one or more output signals at feed ports 600, 602. Alternatively, when the antenna array 102 operates in transmit mode, the feed network 112 may guide signals provided at feed ports 600, 602 to each of the antennas 110. Thus it is to be appreciated that although the following discussion will refer primarily to operation in the receiving mode, the antenna array (antennas and feed network) may also operate in transmit mode. It is also to be appreciated that although the feed network is illustrated as a waveguide feed network, the feed network may be implemented using any suitable technology, such as printed circuit, coaxial cable, etc.

Figure 16:
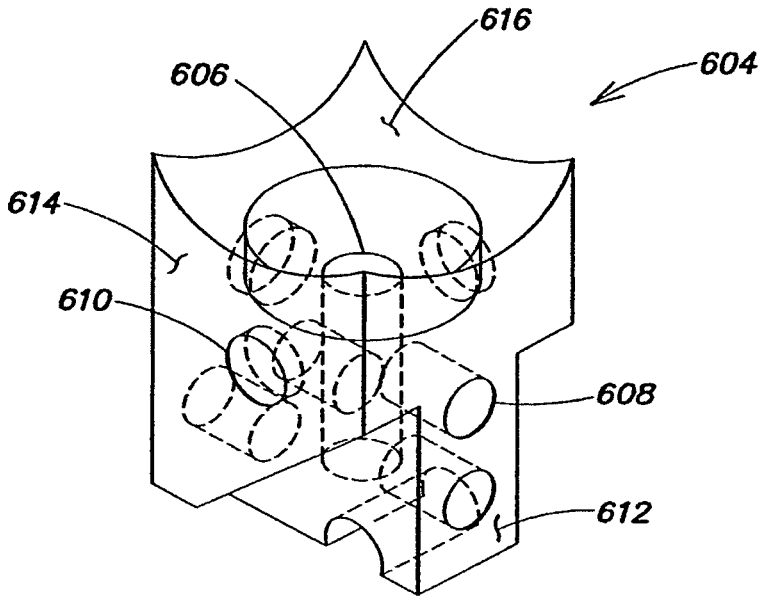
FIG. 16 is a depiction of one embodiment of an orthomode transducer according to the invention.

According to one embodiment, each antenna 110 may be coupled, at its feed point ((FIG. 5, 120) to an orthomode transducer (OMT) 604, as shown in FIGS. 4 and 15. The OMT 604 may provide a coupling interface between the horn antenna 110 and the feed network 112. Referring to FIG. 16, there is illustrated in more detail one embodiment of an OMT 604 according to the invention. The OMT 604 may receive an input signal from the antenna element at a first port 606 and may provide two orthogonal component signals at ports 608 and 610. Thus, the OMT 604 may separate an incoming signal into a first component signal which may be provided, for example, at port 608, and a second, orthogonal component signal which may be provided, for example, at port 610. From these two orthogonal component signals, any transmitted input signal may be reconstructed by vector combining the two component signals using, for example, the PCU 200 (FIG. 2), as will be discussed in more detail below.

In the illustrated example in FIG. 16, the ports 608, 610 of the OMT 604 are located on sides 612, 614 of the OMT 604, at right angles to the input port 606. This arrangement may reduce the height of the OMT 604 compared to conventional OMT's which may typically have one output port located on an underside of the OMT, in-line with the input port. The reduced height of the OMT 604 may help to reduce the overall height of the antenna array 102 which may be desirable in some applications. According to the example shown in FIG. 16, OMT 604 includes a rounded top portion 616 so that the OMT 604 may fit adjacent to sides of the horn antenna element, further facilitating reducing the height of the antenna array. In one example, the OMT 604 may be integrally formed with the horn antenna 110. It is further to be appreciated that although the OMT 604 has been described in terms of the antenna receiving radiation, i.e. the OMT 604 receives an input from the antenna at port 606 and provides two orthogonal output signals at ports 608, 610, the OMT 604 may also operate in the reverse. Thus, the OMT 604 may receive two orthogonal input signals at ports 608, 610 and provide a combined output signal at port 606 which may be coupled to the antenna that may radiate the signal.

The ports 608, 610 of the OMT 604 may not necessarily be perfectly phase-matched and thus the first component signal provided at port 608 may be slightly out of phase with respect to the second component signal provided at port 610. In one embodiment, the PCU may be adapted to correct for this phase imbalance, as will be discussed in more detail below.

Referring again to FIG. 15, the feed network 112 includes a plurality of path elements connected to each of the ports 608, 610 of the OMT's 604. The feed network 112 may include a first path 618 (shown hatched) coupled to the ports 608 of the OMT's 604 along which the first component signals (from each antenna) may travel to the first feed port 600. The feed network 112 may also include a second path 620 coupled to the ports 610 of the OMT's 604 along which the second component signals (from each antenna) may travel to the second feed port 602. Thus, each of the orthogonally polarized component signals may travel a separate path from the connection points OMT ports 608, 610 to the corresponding feed ports 600, 602 of the feed network 112. According to one embodiment, the first and second paths 618, 620 may be symmetrical, including a same number of bends and T-junctions, such that the feed network 112 does not impart any phase imbalance to the first and second component signals.

As shown in FIG. 15, the feed network 112 may include a plurality of E-plane T-junctions 622 and bends 624. When the antenna array is operating in receive mode, the E-plane T-junctions may operate to add signals received from each antenna to provide a single output signal. When the antenna array is operating in transmit mode, the E-plane T-junctions may serve as power-dividers, to split a signal from a single feed point to feed each antenna in the array. In the illustrated example, the waveguide T-junctions 622 include narrowed sections 626, with respect to the width of the remaining sections 628, that perform a function of impedance matching. The narrowed sections 626 have a higher impedance than the wider sections 628 and may typically be approximately one-quarter wavelength in length. In one example, as illustrated, the waveguide T-junctions 622 may include a notch 630 that may serve to decrease phase distortion of the signal as it passes through the T-junction 622. Providing rounded bends 624, as shown, allows the feed network 112 to take up less space than if right-angled bends were used, and also may serve to decrease phase distortion of the signal as it passes through the bend 624. Each of the first and second paths 618, 620 in the feed network 112 may have the same number of bends in each direction so that the first and second component signals receives an equal phase delay from propagation through the feed network 112.

Figure 17:
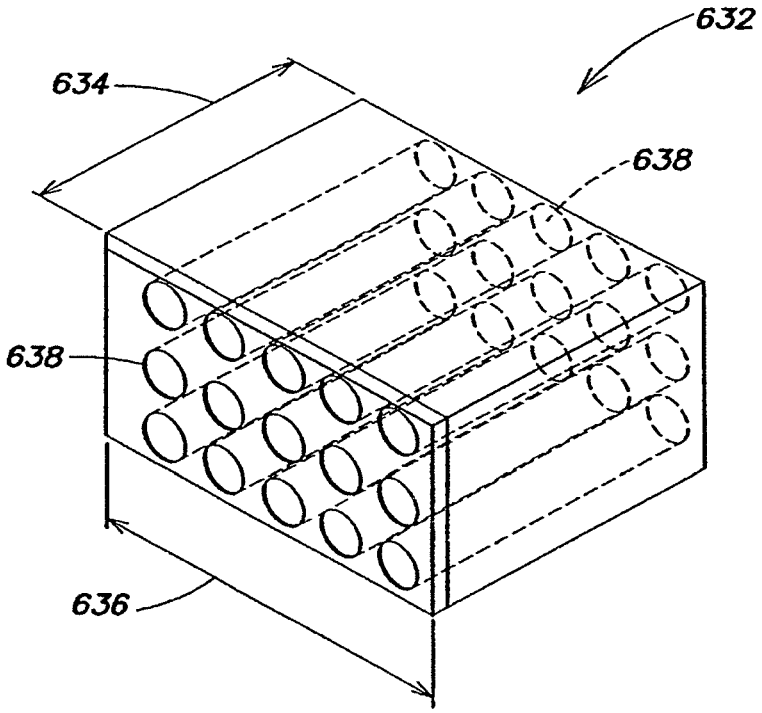
FIG. 17 is a perspective view of one embodiment of a dielectric insert that may be used with the feed network, according to the invention.

According to one embodiment, a dielectric insert may be positioned within the feed ports 600, 602 of the feed network 112. FIG. 17 illustrates one example of a dielectric insert 632 that may be inserted into the E-plane T-junctions. The size of the dielectric insert 632 and the dielectric constant of the material used to form the dielectric insert 632 may be selected to improve the RF impedance match and transmission characteristics between the ports of the waveguide T-junction forming the feed ports 600, 602. In one example, the dielectric insert 632 may be constructed from Rexolite®. The length 634 and width 636 of the dielectric insert 632 may be selected so that the dielectric insert 632 fits snugly within the feed ports 600, 602. In one example, the dielectric insert 632 may have a plurality of holes 638 formed therein. The holes 638 may serve to lower the effective dielectric constant of the dielectric insert 632 such that a good impedance match may be achieved.

Referring again to FIG. 15, in one example, the feed network 112 may comprise one or more brackets 660 for mechanical stability. The brackets 660 may be connected, for example, between adjacent OMT's 604, to provide additional structural support for the feed network 112. The brackets 660 do not carry the electromagnetic signals. In one example, the brackets 660 may be integrally formed with the feed network 112 and may comprise a same material as the feed network 112. In another example, the brackets 660 may be welded or otherwise attached to sections of the feed network 112.

Figure 18:
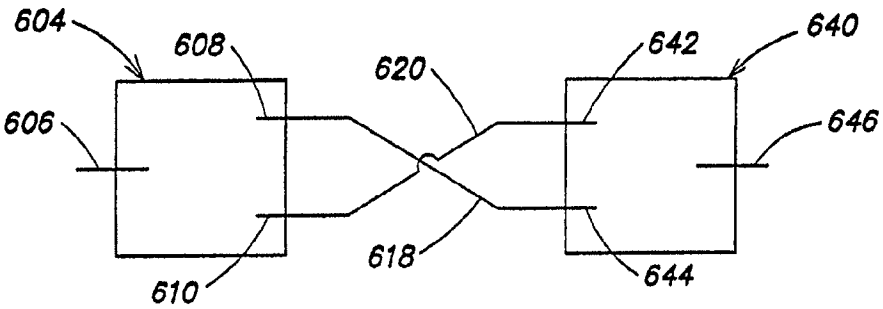
FIG. 18 is a diagrammatic representation of one embodiment of a feed structure incorporating two OMT's according to the invention.

According to another embodiment, the waveguide feed network 112 may include a feed orthomode transducer (not shown) coupled to each of the feed ports 600, 602. Referring to FIG. 18, the feed orthomode transducer (OMT) 640 may include a first port 642 and a second port 644 to receive the first and second orthogonal component signals from the feed ports 600, 602, respectively. The feed OMT 640 receives the orthogonal first and second component signals at ports 642 and 644 and provides a combined signal at its output port 646. The feed OMT 640 may be substantially identical to the OMT 604 and may be fed orthogonally to the OMT's 604 coupled to the antennas. For example, the first component signal may be provided at port 608 of OMT 604, and may travel along the first path 618 of the feed network 112 to feed port 600 which may be coupled to the second port 644 of OMT 640, as shown in FIG. 18. Similarly, the second port 610 of OMT 604 may be coupled, via the second path 620 and feed port 602 of the feed network 112 to the first port 642 of OMT 640. The first component signal receives a first phase delay $\phi_1$ from OMT 604, a path delay $\phi_p$, and a second phase delay $\phi_2$ from OMT 640. Similarly, the second component signal receives a first phase delay $\phi_2$ from OMT 604, a path delay $\phi_p$, and a second phase delay $\phi_1$ from OMT 640. Thus, the combination of the two OMT's 604, 640, orthogonally fed, may cause each of the first and second component signals to receive a substantially equal total phase delay, as shown below in equation 4, $$\Phi[\omega t+\phi_1)+\phi_p+\phi_2]=\Phi[(\omega t+\phi_2)+_p+\phi_1] \quad (4)$$

where $(\omega t+\phi_1)$ and $(\omega t+\phi_2)$ are the polarized first and second component signals and which are phase matched at the output port 646 of the feed OMT 640.

According to another embodiment, the feed ports 600, 602 of the feed network 112 may be coupled directly to the PCU, without a feed OMT, and the PCU may be adapted to provide polarization compensation and phase matching to compensate for any difference between $\phi_1$ and $\phi_2$, as will be discussed in more detail below.

Figure 19:
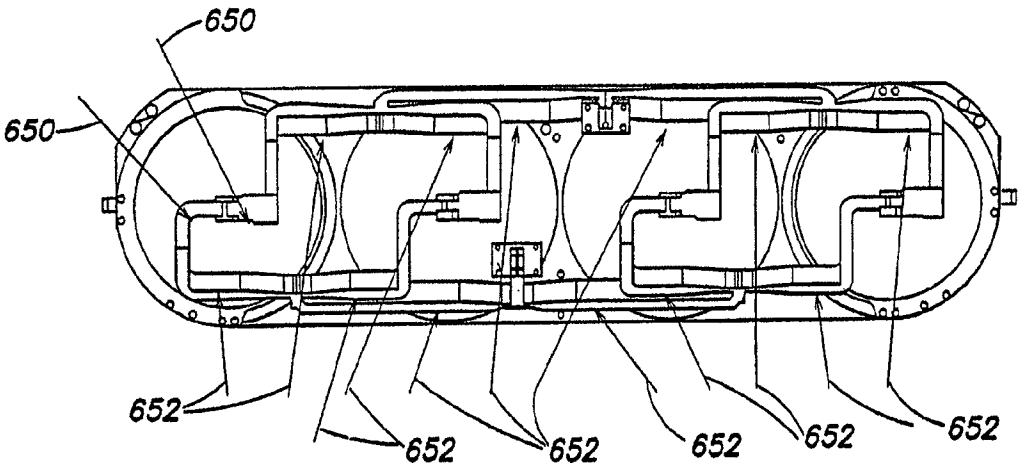
FIG. 19 is a depiction of a feed network illustrating one example of positions for drainage holes, according to the invention.

In some applications, the antenna array may be exposed to a wide range of temperatures and varying humidity. This may result in moisture condensing within the feed network and antennas. In order to allow any such moisture to escape from the feed network, a number of small holes may be drilled in sections of the feed network, as shown by arrows 650, 652 in FIG. 19. At some locations, indicated by, for example, arrows 650, single holes may be drilled having a diameter of, for example, about 0.060 inches. In other locations, indicated for example by arrows 652, sets of two or three holes spaced apart by, for example, 0.335 inches, may be drilled. Each hole in such a set of holes may also have a diameter of about 0.060 inches. It is to be appreciated that the locations and the number of the holes illustrated in FIG. 19 are merely exemplary and that the sizes and spacings given are merely examples also. The invention is not limited to the particular sizes and positions of the holes illustrated herein and any number of holes may be used, positioned at different locations in the feed network 112.

Figure 20:
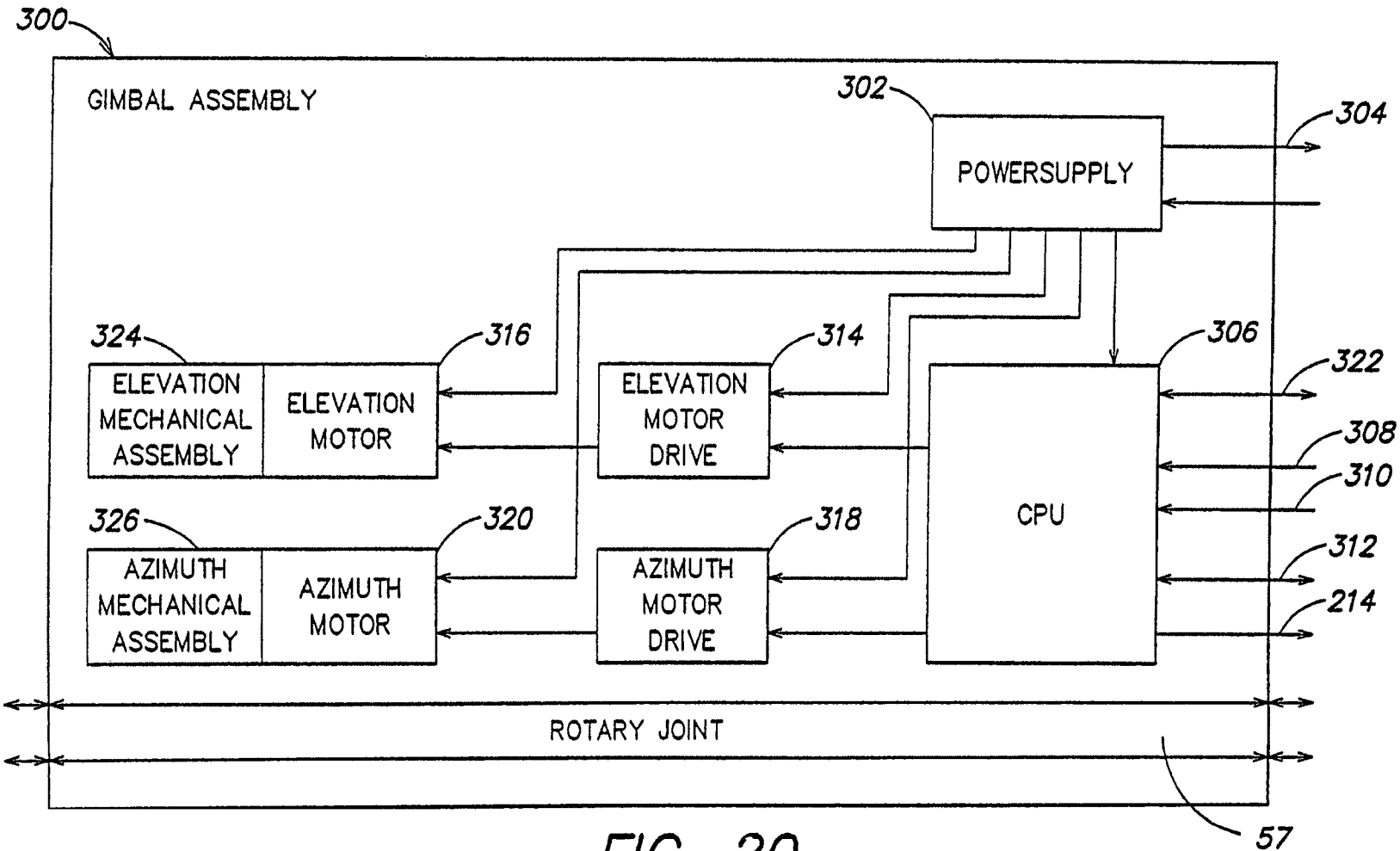
FIG. 20 is a functional block diagram of a one embodiment of a gimbal assembly according to the invention.

Referring to FIG. 20 there is illustrated a functional block diagram of one embodiment of a gimbal assembly 300. As discussed above, the gimbal assembly 300 may form part of the mountable subsystem 50 that may be mounted on a passenger vehicle, such as, for example, an aircraft. It is to be appreciated that while the following discussion will refer primarily to a system where the mountable subsystem 50 is externally located on an aircraft 52, as shown in FIG. 1B, the invention is not so limited and the gimbal assembly 300 may be located internally or externally on any type of passenger vehicle. The gimbal assembly 300 may provide an interface between the antenna assembly 100 (see FIG. 2) and a receiver front-end. According to the illustrated example, the gimbal assembly 300 may include a power supply 302 that may supply the gimbal assembly itself and may provide power on line 304 to other components, such as, the PCU and DCU. The gimbal assembly 300 may also include a central processing unit (CPU) 306. The CPU 306 may receive input signals on lines 308, 310, 312 that may include data regarding the system and/or the information signal source, such as system coordinates, system attitude, source longitude, source polarization skew and source signal strength. In one example, the data regarding the source may be received over an RS-422 interface, however, the system is not so limited and any suitable communication link may be used. The gimbal assembly 300 may provide control signals to the PCU 200 (see FIG. 2) to cause the PCU 200 to correct for polarization skew between the information source and the antenna assembly, as will be discussed in more detail below.

The gimbal assembly 300 may further provide operating power to the PCU 200. In addition, providing the control lines to the PCU and DCU via the gimbal assembly 300 may minimize the number of lines that need to pass through the mounting bracket 58, as well as the number of wires in a cable bundle that may be used to interconnect the antenna assembly 100 and devices such as, for example, as a display or speaker, that may be located inside the vehicle for access by passengers. An advantage of reducing the number of discrete wires in the slip ring is in an increase in overall system reliability. Additionally, some advantages of reducing the number of wires in the bundle and reducing the overall bundle diameter, for example, with smaller bend radii are that the cable installation is easier and a possible reduction in crosstalk between cables carrying the control information.

Referring to FIG. 20, the gimbal assembly 300 may control an azimuth and elevation angle of the antenna assembly, and thus may include an elevation motor drive 314 that drives an elevation motor 316 to move the antenna array in elevation, and an azimuth motor drive 318 that drives an azimuth motor 320 to control and position the antenna array in azimuth. The antenna array may be mounted to the gimbal assembly by the ring, arm and post arrangement described with respect to FIG. 14, and the elevation motor 316 may move the antenna array in elevation angle with respect to the posts of the gimbal assembly 300 over an elevation angle range of approximately −10° to 90° (or zenith). The CPU 306 may utilize the input data received on lines 308, 310, 312 to control the elevation and azimuth motor drives to point the antenna correctly in azimuth and elevation to receive a desired signal from the information source. The gimbal assembly 300 may further include elevation and azimuth mechanical assemblies, 324, 326 that may provide any necessary mechanical structure for the elevation and azimuth motors to move the antenna array.

According to another embodiment, the CPU 306 of the gimbal assembly 300 may include a tracking loop feature. In this embodiment, the CPU 304 may receive a tracking loop voltage from the DCU 400 (see FIG. 2) on line 322. The tracking loop voltage may be used by the CPU 306 to facilitate the antenna array correctly tracking a peak of a desired signal from the information source as the vehicle moves. The tracking loop feature will be discussed in more detail in reference to the DCU.

Figure 21:
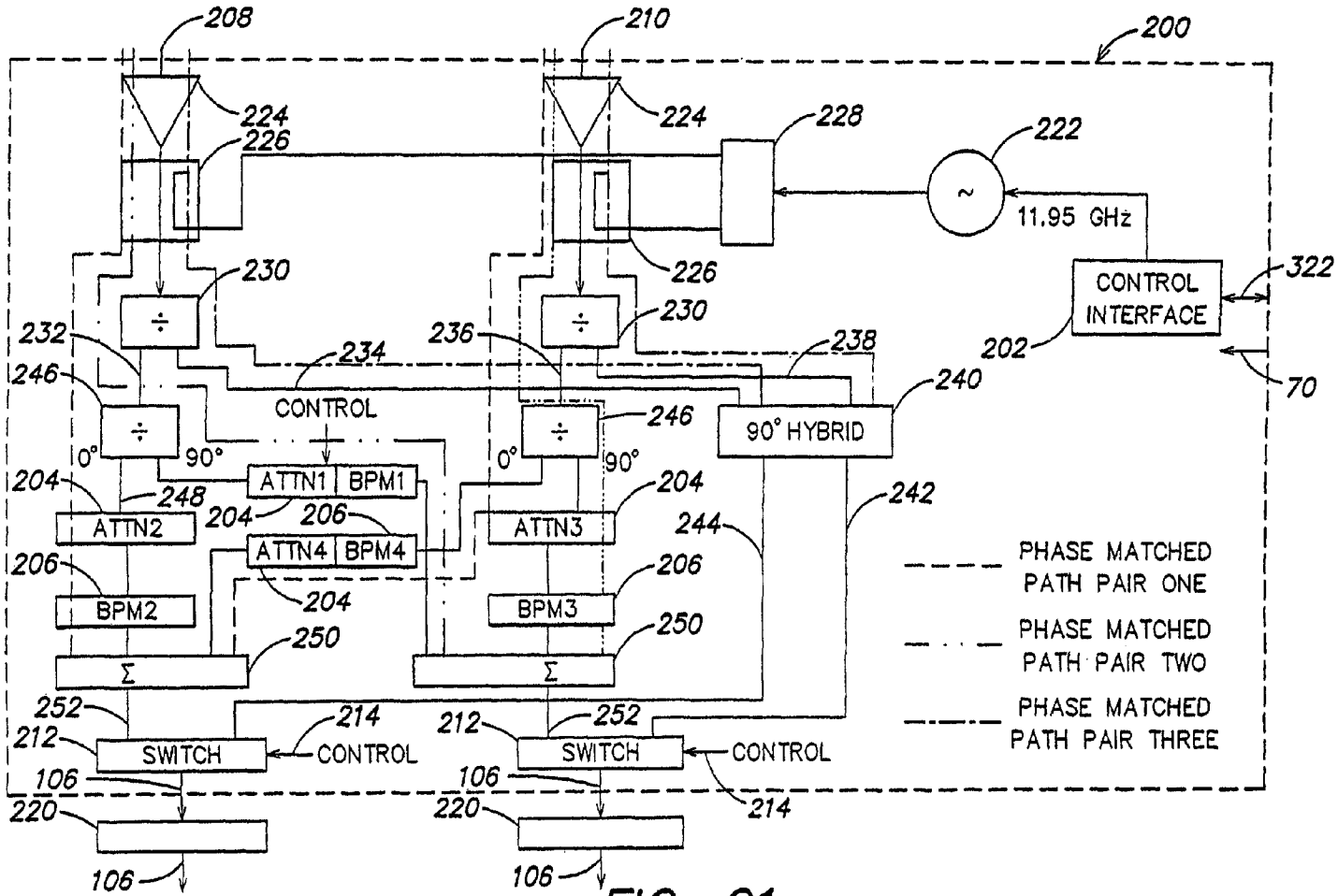
FIG. 21 is a functional block diagram of one embodiment of a polarization converter unit according to the invention.

Referring to FIG. 21, there is illustrated a functional block diagram of one embodiment of a polarization converter unit (PCU) 200. The PCU 200 may be part of the antenna assembly 100 (see FIG. 2), as described above. The PCU 200 converts orthogonal guided waves (the orthogonal first and second component signals presented at feed ports 600, 602 of the feed network described above) into linearly polarized (vertical and horizontal) or circularly polarized (left hand or right hand) signals that represent a transmitted waveform from the signal source. According to one example, the PCU 200 is adapted to compensate for any polarization skew β between the information source and the antenna array. For example, the vehicle 52 (see FIG. 1B) may be an aircraft and the PCU 200 may be adapted to compensate for polarization skew β caused by the relative position of the information source 56 and the vehicle 52, including any pitch, roll, and yaw of the vehicle 52. The PCU 200 may be controlled by the gimbal assembly 300, and may receive control signals on lines 322 via a control interface 202, from the gimbal 300 assembly that enable it to correctly compensate for the polarization skew. The PCU 200 may also receive power from the gimbal assembly 300 via line(s) 70.

Satellite (or other communication) signals may be transmitted on two orthogonal wave fronts. This allows the satellite (or other information source) to transmit more information on the same frequencies and rely on polarization diversity to keep the signals from interfering. If the antenna array 102 is directly underneath or on a same meridian as the transmit antenna on the satellite (or other information source), the receive antenna array 1-2 and the transmit source antenna polarizations may be aligned. However, if the vehicle 52 moves from the meridian or longitude on which information source is located, a polarization skew β is introduced between the transmit and receive antenna. This skew can be compensated for by physically or electronically rotating the antenna array 102. Physically rotating the antenna array 102 may not be practical since it may increase the height of the antenna array. Therefore, it may be preferable to electronically "rotate" the antenna array to compensate for any polarization skew. This "rotation" may be done by the PCU.

Referring again to FIG. 21, the PCU may receive the first and second orthogonal component signals, from the feed ports 600, 602 of the feed network, on lines 208, 210, respectively. In one example, the first and second component signals may be in a frequency range of approximately 10.7 GHz-12.75 GHz. The first and second component signals may be amplified by low noise amplifiers 224 that may be coupled to the ports 600, 602 of the feed network by a waveguide feed connection. The low noise amplifiers are coupled to directional couplers 226 via, for example, semi-rigid cables. The coupled port of the directional couplers 226 is connected, to a local oscillator 222. The local oscillator 222 may be controlled, through the control interface 202, by the gimbal assembly (which communicates with the control interface 202 over line(s) 322) to provide a built-in-test feature. In one example, the local oscillator 222 may have a center operating frequency of approximately 11.95 GHz.

As shown in FIG. 21, the through port of the directional couplers 226 are coupled to power dividers 230 that divide the respective component signals in half (by energy), thereby providing four PCU signals. For clarity, the PCU signals will be referred to as follows: the first component signal (which is, for example, horizontally polarized) is considered to have been split to provide a first PCU signal on line 232 and a second PCU signal on line 234; the second component signal (which is, for example, vertically polarized) is considered to have been split to provide a third PCU signal on line 236 and a fourth PCU signal on line 238. Thus, half of each component signal (vertical and horizontal) is sent to circular polarization electronics and the other half is sent to linear polarization electronics.

Considering the path for circular polarization, lines 234 and 238 provide the second and fourth PCU signals to a 90° hybrid coupler 240. The 90° hybrid coupler 240 thus receives a vertically polarized signal (the fourth PCU signal) and a horizontally polarized signal (the second PCU signal) and combines them, with a phase difference of 90°, to create right and left hand circularly polarized resultant signals. The right and left hand circularly polarized resultant signals are coupled to switches 212 via lines 242 and 244, respectively. The PCU therefore can provide right and/or left hand circularly polarized signals from the vertically and horizontally polarized signals received from the antenna array.

From the dividers 230, the first and third PCU signals are provided on lines 232 and 236 to second dividers 246 which divide each of the first and third PCU signals in half again, thus creating four signal paths. The four signal paths are identical and will thus be described once. The divided signal is sent from the second divider 246, via line 248 to an attenuator 204 and then to a bi-phase modulator (BPM) 206. For linear polarization, the polarization slant, or skew angle, may be set by the amount of attenuation that is set in each path. Zero and 180 degree phase settings may be used to generate the tilt direction, i.e., slant right or slant left. The amount of attenuation is used to determine the amount of orthogonal polarization that is present in the output signal. The attenuator values may be established as a function of polarization skew β according to the equation 5:

$$A=10*\log((\tan(\beta))^2$$

The value of the polarization skew β may be provided via the control interface 202. For example, if the input polarizations are vertical and horizontal (from the antenna array) and a vertical output polarization (from the PCU) is desired, no attenuation may be applied to the vertical path and a maximum attenuation, e.g., 30 dB, may be applied to the horizontal path. The orthogonal output port may have the inverse attenuations applied to generate a horizontal output signal. To generate a slant polarization of 45 degrees, no attenuation may be applied to either path and a 180 degree phase shift may be applied to one of the inputs to create the orthogonal 45 degree output. Varying slant polarizations may be generated by adjusting the attenuation values applied to the two paths and combining the signals. The BPM 206 may be used to offset any phase changes in the signals that may occur as a result of the attenuation. The BPM 206 is also used to change the phase of orthogonal signals so that the signals add in phase. The summers 250 are used to recombine the signals that were divided by second dividers 246 to provide two linearly polarized resultant signals that are coupled to the switches 212 via lines 252.

The switches are controlled, via line 214, by the control interface 202 to select between the linearly or circularly polarized pairs of resultant signals. Thus, the PCU may provide at its outputs, on lines 106, a pair of either linearly (with any desired slant angle) or circularly polarized PCU_output signals. According to one example, the PCU may include, or be coupled to, equalizers 220. The equalizers 220 may serve to compensate for variations in cable loss as a function of frequency—i.e., the RF loss associated with many cables may vary with frequency and thus the equalizer may be used to reduce such variations resulting in a more uniform signal strength over the operating frequency range of the system.

The PCU 200 may also provide phase-matching between the vertically and horizontally polarized or left and right hand circularly polarized component signals. The purpose of the phase matching is to optimize the received signal. The phase matching increases the amplitude of received signal since the signals received from both antennas are summed in phase. The phase matching also reduces the effect of unwanted cross-polarized transmitted signals on the desired signal by causing greater cross-polarization rejection. Thus, the PCU 200 may provide output component signals on lines 106 (see FIG. 2), that are phase-matched. The phase-matching may be done during a calibration process by setting phase sits with a least significant bit (LSB) of, for example, 2.8°. Thus, the PCU may act as a phase correction device to reduce or eliminate any phase mismatch between the two component signals.

According to one embodiment, the PCU 200 may provide all of the gain and phase matching required for the system, thus eliminating the need for expensive and inaccurate phase and amplitude calibration during system installation. As known to those familiar with the operation of satellites in many regions of the world, there exists a variety of satellites operating frequencies resulting in broad bands of frequency operations. Direct Broadcast satellites, for example, may receive signals at frequencies of approximately 14.0 GHz-14.5 GHz, while the satellite may send down signals in a range of frequencies from approximately 10.7 GHz-12.75 GHz. Table 1 below illustrates some of the variables, in addition to frequency, that exist for reception of direct broadcast signals, which are accommodated by the antenna assembly and system of the present invention.

| Service Region | Service Provider | Satellites | Satellite Longitude | Polarization | Primary Conditional Access | Digital Broadcast Format |
|---|---|---|---|---|---|---|
| Canada | ExpressVu | Nimiq | 268.8° E | Circular | Nagravision | DVB |
| CONUS | DIRECTV | DBS 1/2/3 | 259.9° E | Circular | Videoguard | DSS |
| Europe | TPS Tele + Digitale Stream | Hot Bird 1-4 | 13.0° E | Linear | Viaccess | DVB |
| Europe | Sky Digital | Astra 2A | 28.2° E | Linear | Mediaguard | DVB |
| Europe | Canal Plus | Astra 1E-1G | 19.2° E | Linear | Viaccess& Mediaguard | DVB |
| Japan | Sky PerfecTV | JCSAT-4A | 124.0° E 128.0° E | Linear | Multi-access | DVB |
| Latin America | DIRECTV GLA | Galaxy 8-i | 265.0° E | Circular | Videoguard | DSS |
| Malaysia | Astro | Measat 1/2 | 91.5° E | Linear | Cryptoworks | DVB |
| Middle East | ADD | Nilesat 101/102 | 353.0° E | Linear | Irdeto | DVB |

By providing all of the gain and phase matching with the PCU and antenna array, a more reliable system with improved worldwide performance may result. By constraining the phase matching and amplitude regulation (gain) to the PCU and antenna, the system of the invention may eliminate the need to have phase-matched cables between the PCU and the mounting bracket, and between the mounting bracket and the cables penetrating a surface of the vehicle to provide radio frequency signals to and from the antenna assembly 100 and the interior of the vehicle. Phase-matched cables, even if accurately phase matched during system installation, may change over time, and temperature shifts may degrade system performance causing poor reception or reduced data transmission rates. Similarly, the rotary joint can be phase matched when new but over time, being a mechanical device, may wear resulting in the phase matching degrading. Thus, it may be particularly advantageous to eliminate the need for these components to be phase-matched, but accomplishing substantially all of the phase-matching of the signals at the PCU.

According to one embodiment, the PCU 200 may operate for signals in the frequency range of approximately 10.7 GHz to approximately 12.75 GHz. In one example, the PCU 200 may provide a noise figure of 0.7 dB to 0.8 dB over this frequency range, which may be significantly lower than many commercial receivers. The noise figure is achieved through careful selection of components, and by impedance matching all or most of the components, over the operating frequency band.

Figure 22:
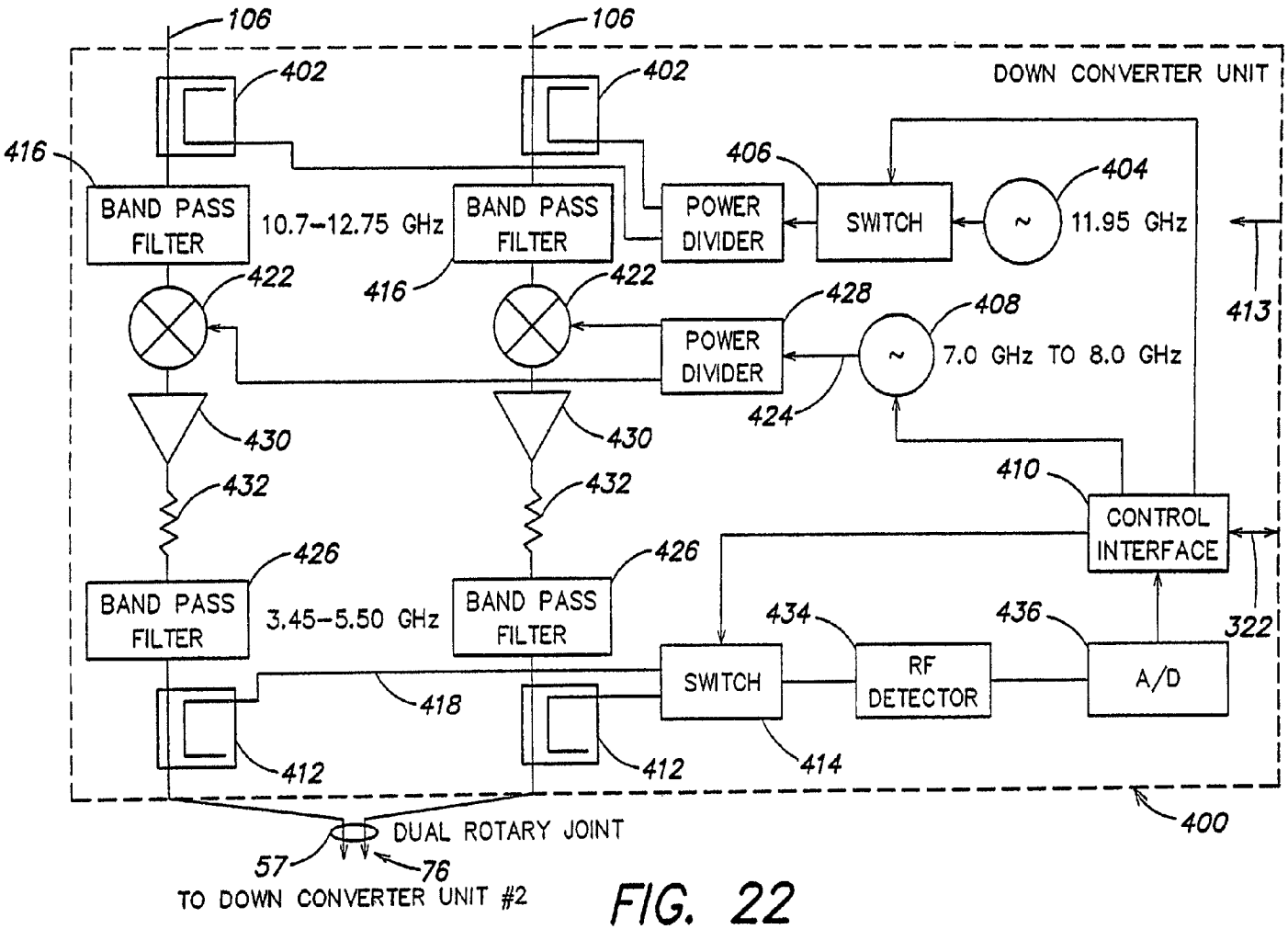
FIG. 22 is a functional block diagram of one embodiment of a down-converter unit according to the invention.

Referring to FIG. 22, there is illustrated a functional block diagram of one embodiment of a down-converter unit (DCU) 400. It is to be appreciated that this figure is only intended to represent the functional implementation of the DCU 400, and not necessarily the physical implementation. The DCU is constructed to take an RF signal, f example, in a frequency range of 10.7 GHz to 12.75 GHz and down-convert it to an intermediate frequency (IF) signal, for example, in a frequency range of 3.45 GHz to 5.5 GHz. In another example, the IF signals on lines 406 may be in a frequency range of approximately 950 MHz to 3000 MHz.

DCU 400 may provide an RF interface between the PCU 200 and a second down-converter unit 500 (see FIG. 2) that may be located within the vehicle. In many applications it may be advantageous to perform the down-conversion operation in two steps, having the first down-converter co-located with the antenna assembly 100 so that the RF signals only travel a short distance from the antenna assembly to the first DCU 400, because most transmission media (e.g. cables) are significantly less lossy at lower, IF frequencies than at RF frequencies. Down conversion to a lower frequency reduces the need for specifying low loss high frequency cable which is typically very bulky and difficult to handle.

According to one embodiment, the DCU 400 may receive power from the gimbal assembly 300 via line 413. The DCU 400 may also be controlled by the gimbal assembly 300 via the control interface 410. According to one embodiment, DCU 400 may receive two RF signals on lines 106 from the PCU 200 and may provide output IF signals on lines 76. Directional couplers 402 may be used to inject a built-in-test signal from local oscillator 404. A switch 406 that may be controlled, via a control interface 410, by the gimbal assembly (which provides control signals on line(s) 322 to the control interface 410) is used to control when the built-in-test signal is injected. A power divider 428 may be used to split a single signal from the local oscillator 404 and provide it to both paths.

Referring again to FIG. 22, the through port of the directional couplers 402 are coupled to bandpass filters 416 that may be used to filter the received signals to remove any unwanted signal harmonics. The filtered signals may then be fed to mixers 422. The mixers 422 may mix the signals with a local oscillator tone received on line 424 from oscillator 408 to down-convert the signals to IF signals. In one example, the DCU local oscillator 408 may be able to tune in frequency from 7 GHz to 8 GHz, thus allowing a wide range of operating and IF frequencies. Amplifiers 430 and attenuators 432 may be used to balance the IF signals. Filters 426 may be used to minimize undesired mixer products that may be present in the IF signals before the IF signals are provided on output lines 76.

As discussed above, the gimbal assembly 300 may include a tracking feature wherein the gimbal CPU 306 uses a signal received from the DCU 400 on line 322 to provide control signals to the antenna array to facilitate the antenna array tracking the information source. According to one embodiment, the DCU 400 may include a control interface 410 that communicates with the gimbal CPU 306 via line 322. The control interface 41 may sample the amplitude of the IF signal on either path using couplers 412 and RF detector 434 to provide amplitude information that may be used by the CPU 306 of the gimbal to track the satellite based on received signal strength. An analog-to-digital converter 436 may be used to digitize the information before it is sent to the gimbal assembly 300. If the DCU is located close to the gimbal CPU, this data may be received at a high rate, e.g. 100 Hz, and may be uncorrupted. Therefore, performing a first down-conversion, to convert the received RF signals to IF signals, close to the antenna may improve overall system performance.

The CPU 306 of the gimbal may include software that may utilize the amplitude information provided by the DCU to point at, or track, an information source such as a satellite. The control interface may provide signals to the gimbal assembly to allow the gimbal assembly to correctly control the antenna assembly to track a desired signal from the source. In one example, the DCU may include a switch 414 that may be used to select whether to track the vertical/RHC or horizontal/LHC signals transmitted from an information source, such as a satellite. In general, when these signals are transmitted from the same satellite, it may be desirable to track the stronger signal. If the signals are transmitted from two satellites that are close, but not the same, it may be preferable to track the weaker satellite.

Allowing the antenna to be pointed at the satellite based on signal strength as well as aircraft coordinates simplifies the alignment requirements during system installation. It allows for an installation error of up to five tenths of a degree versus one tenth of a degree without it. The system may also use a combined navigation and signal strength tracking approach, in which the navigation data may be used to establish a limit or boundary for the tracking algorithm. This minimizes the chances of locking onto the wrong satellite because the satellites are at least two or more degrees apart. By using both the inertial navigation data and the peak of the signal found while tracking the satellite, it may be possible to calculate the alignment errors caused during system installation and correct for them in the software.

According to one embodiment, a method and system for pointing the antenna array uses the information source (e.g., a satellite) longitude and vehicle 52 (e.g., an aircraft) coordinates (latitude and longitude), vehicle attitude (roll, pitch and yaw) and installation errors (delta roll, delta pitch, and delta yaw) to compute where the antenna should be pointing. As known to those experienced in the art, geometric calculations can be easily used to determine look angles to geostationary satellites from known coordinates, including those from aircraft. Signal tracking may be based on using the received satellite signal strength to optimize the antenna orientation dynamically. During tracking the gimbal CPU may use the amplitude of the received signal (determined from the amplitude information received from the DCU) to determine the optimum azimuth and elevation pointing angle by discretely repositioning the antenna from its calculated position to slight offset positions and determining if the signal received strength is optimized, and if not repositioning the antenna orientation in the optimized direction, and so forth. It is to be appreciated that pointing may be accurate and precise, so if, for example, the aircraft inertial navigation system is later changed, the alignment between the antenna array coordinates and the Inertial Navigation System may have to be recalculated.

In general when a navigation system is replaced in an aircraft or other vehicle, it is accurately placed to within a few tenths of a degree to the old Inertial Navigation System. However, this few tenths of a degree can cause the Antenna System to not point at the satellite accurately enough for the onboard receivers to lock on the signal using only a pointing calculation, and thus may result in loss of picture for the passenger. If the Inertial Navigation System is replaced, the Antenna System should be realigned within one or two tenths of a degree when using a pointing-only antenna system. In conventional systems this precision realignment can be a very time consuming and tedious process and thus may be ignored, impairing performance of the antenna system. The present system has both the ability to point and track, and thus the alignment at installation may be simplified and potentially eliminated since the tracking of the system can make up for any alignment or pointing errors, for example, if the replacement Inertial Navigation system is installed within 0.5 degrees with respect to the preceding Inertial Navigation coordinates The system may be provided with an automatic alignment feature that may implemented, for example, in software running on the gimbal CPU. When automatic alignment is requested, the system may initially use the inertial navigation data to point at a chosen satellite. Maintenance personnel can request this action from an external interface, such as a computer, that may communicate with the gimbal CPU. When the antenna array has not been aligned, the system starts scanning the area to look for a peak received signal. When it finds the peak of the signal it may record the azimuth, elevation, roll, pitch, yaw, latitude and longitude. The peak may be determined when the system has located the highest signal strength. The vehicle may then be moved and a new set of azimuth, elevation, roll, pitch, yaw, latitude and longitude numbers are measured. With this second set of numbers the system may compute the installation error delta roll, delta pitch and delta yaw and the azimuth and elevation pointing error associated with these numbers. This process may be repeated until the elevation and azimuth pointing errors are acceptable.

The conventional alignment process is typically only performed during initial antenna system installation and is done by manual processes. Conventional manual processes usually do not have the ability to input delta roll, delta pitch and delta yaw numbers, so the manual process requires the use of shims. These shims are small sheets of filler material, for example aluminum shims, that are positioned between the attachment base of the antenna and the aircraft, for example. to force the Antenna System coordinates to agree with the Navigation System coordinates. However, the use of shims requires the removal of the radome, the placement of shims and the reinstallation of the radome. This is a very time consuming and dangerous approach. Only limited people are authorized to work on top of the aircraft and it requires a significant amount of staging. Once the alignment is completed the radome has to be reattached and the radome seal cured for several hours. This manual alignment process can take all day, whereas the automatic alignment process described herein can be performed in less than 1 hour.

Once properly aligned, pointing computations alone are generally sufficient to keep the antenna pointed at the information source. In some instances it is not sufficient to point the antenna array at the satellite using only the Inertial Navigation data. Some Inertial Navigation systems do not provide sufficient update rates for some high dynamic movements, such as, for example, taxiing of an aircraft. (Conventional antenna systems are designed to support a movement of 7 degrees per second in any axis and an acceleration of 7 degrees per second per second.). One way to overcome this may be to augment the pointing azimuth and elevation calculated with a tracking algorithm. The tracking algorithm may always be looking for the strongest satellite signal, thus if the Inertial Navigation data is slow, the tracking algorithm may take over to find the optimum pointing angle. When the Inertial Navigation data is accurate and up to date, the system may use the inertial data to compute its azimuth and elevation angles since this data will coincide with the peak of the beam. This is because the Inertial Navigation systems coordinates may accurately point, without measurable error, the antenna at the intended satellite, that is predicted look angles and optimum look angles will be identical. When the Inertial Navigation data is not accurate the tracking software may be used to maintain the pointing as it inherently can "correct" differences between the calculated look angles and optimum look angles up to 0.5 degrees.

Figure 23:
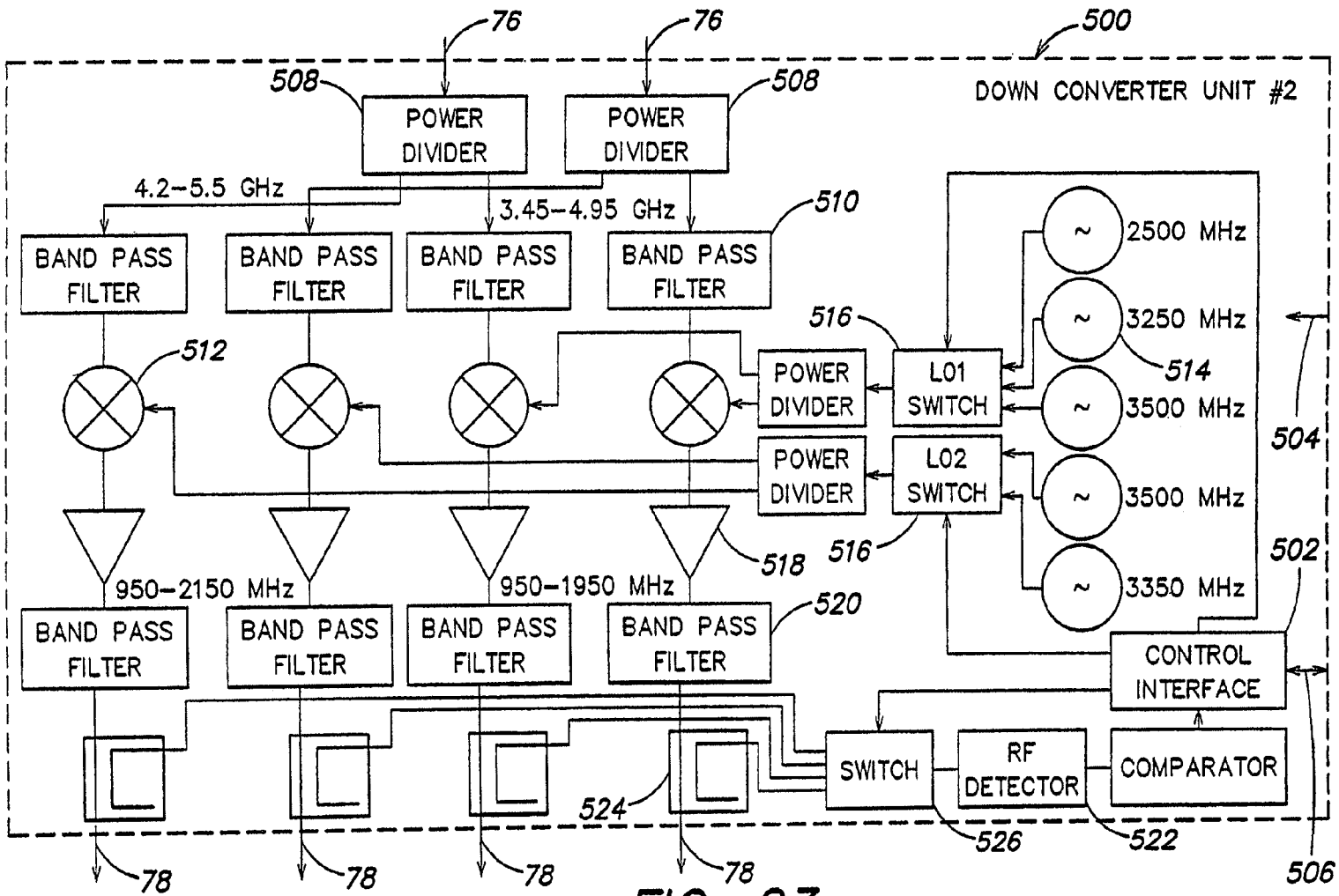
FIG. 23 is a functional block diagram of one embodiment of a second down-converter unit, according to the invention.

According to another embodiment, the communication system of the invention may include a second down-converter unit (DCU-2) 500. FIG. 23 illustrates a functional block diagram of an example of DCU-2 500. It is to be appreciated that FIG. 23 is intended to represent a functional implementation of the DCU-2 500 and not necessarily the physical implementation. The DCU-2 500 may provide a second stage of down-conversion of the RF signals received by the antenna array to provide IF signals that may be provided to, for example, passenger interfaces within a vehicle. The DCU-2 500 may receive power, for example, from the gimbal assembly 300 over line(s) 504. The DCU-2 500 may include a control interface (CPU) 502 that may receive control signals on line 506 from the gimbal assembly 300.

According to one embodiment, the DCU-2 500 may receive input signals on lines 76 from the DCU 400. Power dividers 508 may be used to split the received signals so as to be able to create high band output IF signals (for example, in a frequency range of 1150 MHz to 2150 MHz) and low band output IF signals (e.g. in a frequency range of 950 MHz to 1950 MHz). Thus, the DCU-2 may provide, for example, four output IF signals, on lines 78, in a total frequency range of approximately 950 MHz to 2150 MHz. Some satellites may be divided into two bands 10.7 GHz to 11.7 GHz and 11.7 GHz to 12.75 GHz. The 10.7 GHz to 11.7 GHz band are down converted to 0.95 GHz to 1.95 GHz and the 11.7 GHz band to 12.75 GHz band are down converted to 1.1 GHz to 2.15 GHz. These signals may be presented to a receiver (not shown), for example, a display or audio output, for access by passengers associated with the vehicle 52 (see FIGS. 1A, 1B). Thus, in order to provide worldwide TV reception on any channel simultaneously, the video receiver may need four separate IF inputs to receive both polarizations of each of the two satellite bands. Generation of these four IF signals could be performed on the antenna assembly, but a quad rotary joint would then be needed on the mounting bracket to pass the four signals to the interior of the vehicle. A quad rotary joint may be impractical and expensive. By providing the first stage of down conversion on the gimbal, the number of RF cables passing through the rotary joint to the interior of the vehicle may be minimized, thus simplifying installation. Also, by providing the first stage of down conversion on the mountable subsystem, a lower frequency may be passed from the antenna array to the video receivers thus allowing for a more common RF cable to be used that is thinner in diameter making it easier to install. Thus, it may be advantageous for the communication system of the invention to provide the two stages of down conversion using the DCU 400 on the mountable subsystem and the DCU-2 500 that may be conveniently located within the vehicle.

According to the illustrated example, the DCU-2 500 may include band-pass filters 510 that may be used to filter out-of-band products from the signals. The received signals are mixed, using mixers 512, with a tone from one of a selection of local oscillators 514. Each local oscillator 514 may be tuned to a particular band of frequencies, as a function of the satellites (or other information signal sources) that the system is designed to receive. Which local oscillator is mixed in mixers 512 at any given time may be controlled, using switches 516, by control signals received from the gimbal assembly by the control interface 502. The output signals may be amplified by amplifiers 518 to improve signal strength. Further band-pass filters 520 may be used to filter out unwanted mixer products. In one example, the DCU-2 500 may include a built-in-test feature using an RF detector 522 and couplers 524 to sample the signals, as described above in relation to the DCU and PCU. A switch 526 (controlled via the control interface 502) may be used to select which of the four outputs is sampled for the built-in-test.

Having thus described several exemplary embodiments of the system, and aspects thereof, various modifications and alterations may be apparent to those of skill in the art. Such modifications and alterations are intended to be included in this disclosure, which is for purposes of illustration only, and not intended to be limiting. The scope of the invention should be determined from proper construction of the appended claims, and their equivalents.

What is claimed is:

1. A communications system comprising:

an antenna array including:

a plurality of antennas configured to receive an information signal from a source, each antenna including a dielectric lens coupled to a respective antenna that focuses the information signal to a feed point of the respective antenna, each dielectric lens having a plano-convex exterior shape that comprises a single step Fresnel feature having a substantially trapezoidal shape, wherein a first boundary of the single step Fresnel feature is formed adjacent and substantially parallel to a planar surface of the dielectric lens and a convex surface of the dielectric lens extends outwardly from an aperture of the respective antenna; and a waveguide feed network coupled to each antenna of the plurality of antennas and constructed and arranged receive the information signal from the plurality of antennas and to guide the signal to a first feed port and a second feed port, the waveguide feed network comprising a plurality of orthomode transducers, each orthomode transducer coupled to a respective one of the plurality of antennas and configured to split the information signal into a first component signal having a first polarization and a second component signal having a second polarization, the second polarization being orthogonal to the first polarization; and a polarization converter unit coupled to the first feed port and a second feed port and configured to compensate for polarization skew between the antenna array and the source;

wherein the feed network is coupled to the plurality of antennas via the plurality of orthomode transducers;

wherein the feed network is constructed and arranged to receive the first component signal and the second component signal from each orthomode transducer and to provide a first summed component signal at the first feed port and a second summed component signal at the second feed port; and wherein the polarization converter unit is coupled to the first and second feed ports and is further configured to receive the first summed component signal and the second summed component signal and to compensate for phase imbalance between the first and second summed component signals and to provide output signals.

2. The communication system as claimed in claim 1, wherein the plurality of antennas includes a plurality of horn antennas.

3. The communications system as claimed in claim 2, wherein the plurality of horn antennas comprises a first horn antenna and a second horn antenna, substantially identical to the first horn antenna.

4. The communications system as claimed in claim 1, wherein each orthomode transducer has a first port and a second port, each orthomode transducer configured to receive the information signal from the corresponding antenna and to provide at the first port the first component signal and to provide at the second port the second component signal.

5. The communications system as claimed in claim 1, wherein the feed network comprises substantially symmetrical paths so that a path of the first component signal from each orthomode transducer to the first feed port and a path of the second component signal from each orthomode transducer to the second feed port are substantially symmetrical.

6. The communications system as claimed in claim 1, further comprising a gimbal assembly coupled to the antenna array and configured to move the antenna array in azimuth and elevation.

7. The communications system as claimed in claim 6, wherein gimbal assembly further includes an elevation drive configured to move the antenna array in elevation and an azimuth drive configured to move the antenna array in azimuth.

8. The communications system as claimed in claim 6, wherein the gimbal assembly includes a mounting bracket configured to mount the antenna array and the gimbal assembly to a host vehicle.

9. The communications system as claimed in claim 6, further comprising a down converter unit configured to receive the output signals;

wherein the gimbal assembly comprises a processor coupled to the down converter unit and configured to receive a first signal from the down converter unit and to provide a control signal to the antenna array based on the first signal to control the antenna array to track the source.

10. The communications system as claimed in claim 9, wherein down converter unit is configured to down convert the output signals in frequency to provide an intermediate frequency signal, and comprises a control interface, a directional coupler and an RF detector;

wherein the directional coupler samples intermediate frequency signal to provide a sampled signal;

wherein the RF detector is configured to detect an amplitude of the sampled signal and to provide a second signal representative of the amplitude of the sampled signal to the control interface; and wherein the control interface is coupled to the processor of the gimbal assembly and is configured to provide the first to the processor, the first signal including amplitude information representative of the amplitude of the sampled signal.

11. The communications system as claimed in claim 10, wherein the processor is configured to use the amplitude information to control the antenna array to track the source based at least in part on signal strength of the information signal.

12. The communications system as claimed in claim 1, wherein the polarization converter unit is co-located with the antenna array.

13. A communications system comprising:

an antenna array including:

a plurality of antennas configured to receive an information signal from a source; and a waveguide feed network coupled to each antenna of the plurality of antennas and constructed and arranged receive the information signal from the plurality of antennas and to guide the signal to a first feed port and a second feed port, the waveguide feed network comprising a plurality of orthomode transducers, each orthomode transducer coupled to a respective one of the plurality of antennas and configured to split the information signal into a first component signal having a first polarization and a second component signal having a second polarization, the second polarization being orthogonal to the first polarization; and a polarization converter unit coupled to the first feed port and a second feed port and configured to compensate for polarization skew between the antenna array and the source;

wherein the feed network is coupled to the plurality of antennas via the plurality of orthomode transducers;

wherein the feed network is constructed and arranged to receive the first component signal and the second component signal from each orthomode transducer and to provide a first summed component signal at the first feed port and a second summed component signal at the second feed port; and wherein the polarization converter unit is coupled to the first and second feed ports and is further configured to receive the first summed component signal and the second summed component signal and to compensate for phase imbalance between the first and second summed component signals and to provide output signals.

14. An antenna assembly comprising:

a first antenna configured to receive a signal from a source;

a second antenna, substantially identical to the first antenna, and configured to receive the signal;

a first dielectric lens coupled to the first antenna and a second dielectric lens coupled to the second antenna, each of the first dielectric lens and the second dielectric lens configured to focus the signal to a feed point of the respective antenna, each of the first dielectric lens and the second dielectric lens having a plano-convex exterior shape comprising a single step Fresnel feature having a substantially trapezoidal shape, wherein a first boundary of the single step Fresnel feature is formed adjacent and substantially parallel to a planar surface of the respective dielectric lens;

a waveguide feed network coupled to the first and second antennas and including a first feed port and a second feed port, the waveguide feed network comprising a plurality of orthomode transducers, each orthomode transducer coupled to a respective one of the plurality of antennas and configured to split the information signal into a first component signal having a first polarization and a second component signal having a second polarization, the second polarization being orthogonal to the first polarization, the waveguide feed network configured to receive the first polarization signal and the second component signal from each orthomode transducer and being constructed to provide a first summed component signal having a first polarization at the first feed port and a second summed component signal having a second, orthogonal, polarization at the second feed port; and a polarization converter unit coupled to the first feed port and the second feed port that is configured to compensate for any polarization skew between the antennas and the source, and to compensate for any phase imbalance between the first summed component signal and the second summed component signal.

15. The communications system antenna as claimed in claim 13, wherein the plurality of antennas are horn antennas.

16. The communications system antenna as claimed in claim 13, wherein the polarization converter unit includes a plurality of attenuators configured to be electronically controllable with a control signal to provide a first value of attenuation in the path of the first summed component signal and a second value of attenuation in the path of the second summed component signal.

17. The communications system as claimed in claim 13, wherein the feed network comprises substantially symmetrical paths so that a path of the first component signal from each orthomode transducer to the first feed port and a path of the second component signal from each orthomode transducer to the second feed port are substantially symmetrical.

18. An aircraft-mounted antenna assembly comprising:

at least one horn antenna adapted to receive an information signal, at least one orthomode transducer coupled to a feed point of the at least one horn antenna, the orthomode transducer having a first port and a second port and being constructed to receive the information signal from the at least one horn antenna and to split the information signal to provide, at the first port, a first component signal having a first polarization and, at the second port, the second component signal having a second polarization orthogonal to the first polarization; and at least one dielectric lens coupled to the at least one horn antenna that focuses the information signal to the feed point of the at least one horn antenna;

wherein the at least one dielectric lens has a plano-convex exterior shape and comprises a single step Fresnel feature having a substantially trapezoidal shape, and wherein a first boundary of the single step Fresnel feature is formed adjacent and substantially parallel to a planar surface of the at least one dielectric lens; and wherein a convex surface of the at least one dielectric lens extends outwardly from an aperture of the at least one horn antenna;

further comprising a polarization converter unit coupled to the at least one orthomode transducer and configured to receive the first and second component signals, the polarization converter unit being constructed to compensate for any phase imbalance between the first and second component signals to phase match the first component signal to the second component signal;

wherein the polarization converter unit is further constructed to compensate for polarization skew between the antenna and a source of the information signal and to reconstruct the information signal, with any polarization, from the first and second component signals;

wherein the polarization converter unit includes a plurality of attenuators and is configured to provide an first value of attenuation in a path of the first component signal and a second value of attenuation in a path of the second component signal, the first and second values of attenuation selected to compensate for the polarization skew between the antenna and the source of the information signal.

19. The aircraft-mounted antenna assembly as claimed in claim 18, wherein a diameter of the dielectric lens is less than approximately 12 inches.

20. The aircraft-mounted antenna assembly as claimed in claim 18, further comprising a gimbal assembly coupled to the at least one horn antenna and adapted to move the at least one horn antenna in azimuth and elevation within a circle of rotation.

21. The aircraft-mounted antenna assembly as claimed in claim 20, wherein the at least one of the horn antenna includes a ring for mounting the horn antenna to the gimbal assembly; and wherein the ring is formed on an outer surface of the horn antenna proximate to an aperture of the horn antenna.

22. The aircraft-mounted antenna assembly as claimed in claim 18, wherein the dielectric lens is a self-centering lens constructed and arranged to fit at least partially inside an aperture of the horn antenna.

23. The communication system as claimed in claim 1, wherein a convex surface of the each dielectric lens extends outwardly from an aperture of the respective antenna.

24. The antenna assembly as claimed in claim 14, wherein a convex surface of the each dielectric lens extends outwardly from an aperture of the respective antenna.

25. The communications system as claimed in claim 13, further comprising a gimbal assembly coupled to the antenna array and adapted to move the antenna array in azimuth and elevation.

26. The communications system as claimed in claim 25, wherein the gimbal assembly further includes an elevation drive configured to move the antenna array in elevation and an azimuth drive configured to move the antenna array in azimuth.

27. The communications system as claimed in claim 25, further comprising a down converter unit configured to receive the output signals;

wherein the gimbal assembly comprises a processor coupled to the down converter unit and configured to receive a first signal from the down converter unit and to provide a control signal to the antenna array based on the first signal to control the antenna array to track the source.

28. The communications system as claimed in claim 27, wherein down converter unit is configured to down convert the output signals in frequency to provide an intermediate frequency signal, and comprises a control interface, a directional coupler and an RF detector;

wherein the directional coupler samples intermediate frequency signal to provide a sampled signal;

wherein the RF detector is configured to detect an amplitude of the sampled signal and to provide a second signal representative of the amplitude of the sampled signal to the control interface; and wherein the control interface is coupled to the processor of the gimbal assembly and is configured to provide the first to the processor, the first signal including amplitude information representative of the amplitude of the sampled signal.

29. The communications system as claimed in claim 28, wherein the processor is configured to use the amplitude information to control the antenna array to track the source based at least in part on signal strength of the information signal.

30. The communications system as claimed in claim 13, wherein the polarization converter unit is co-located with the antenna array.

31. The communications system as claimed in claim 13, further comprising a phase correction device coupled to the first feed port and the second feed port of the waveguide feed network and adapted to receive the first summed component signal and the second summed component signal from the waveguide feed network;

wherein the phase correction device is adapted to phase match the first summed component signal with the second summed component signal.

32. The communication system as claimed in claim 13, wherein the plurality of orthomode transducers are integrally formed with the feed network and with the plurality of antennas.

33. The communication system as claimed in claim 15, wherein a height of the horn antenna is less than approximately 12 inches.

34. The communication system as claimed in claim 13, further comprising a radome at least partially enclosing the plurality of antennas and the feed network.

35. The communication system as claimed in claim 13, wherein the polarization converter unit includes a plurality of attenuators configured to provide a first value of attenuation in a path of the first component signal and a second value of attenuation in a path of the second component signal, the first and second values of attenuation selected to compensate for the polarization skew between the antenna array and the source of the information signal.

* * * * *

UNITED STATES PATENT AND TRADEMARK OFFICE

CERTIFICATE OF CORRECTION

PATENT NO. : 8,760,354 B2
APPLICATION NO. : 12/876552
DATED : June 24, 2014
INVENTOR(S) : Richard E. Clymer et al.

It is certified that error appears in the above-identified patent and that said Letters Patent is hereby corrected as shown below:

In the Claims:

At Column 30, claim number 15, line number 26, delete “antenna”.

At Column 30, claim number 16, line number 28, delete “antenna”.

Signed and Sealed this
Tenth Day of February, 2015

Michelle K. Lee

Michelle K. Lee
*Deputy Director of the United States Patent and Trademark Office*